US009441365B2

(12) United States Patent
Richardson et al.

(10) Patent No.: US 9,441,365 B2
(45) Date of Patent: Sep. 13, 2016

(54) STAY-IN-PLACE FORMWORK WITH ANTI-DEFORMATION PANELS

(71) Applicant: CFS Concrete Formng Systems Inc., Vancouver (CA)

(72) Inventors: George David Richardson, Vancouver (CA); Semion Krivulin, Richmond (CA); Zi Li Fang, New Westminster (CA)

(73) Assignee: CFS Concrete Forming Systems Inc., Vancouver, British Columbia (CA)

( * ) Notice: Subject to any disclaimer, the term of this patent is extended or adjusted under 35 U.S.C. 154(b) by 14 days.

(21) Appl. No.: 14/360,571

(22) PCT Filed: Nov. 23, 2012

(86) PCT No.: PCT/CA2012/050849

§ 371 (c)(1),
(2) Date: May 23, 2014

(87) PCT Pub. No.: WO2013/075250

PCT Pub. Date: May 30, 2013

(65) Prior Publication Data

US 2014/0318067 A1 Oct. 30, 2014

Related U.S. Application Data

(60) Provisional application No. 61/563,594, filed on Nov. 24, 2011.

(51) Int. Cl.
*E04B 2/00* (2006.01)
*E04B 2/86* (2006.01)
(Continued)

(52) U.S. Cl.
CPC ..... *E04B 2/8641* (2013.01); *E04B 2/8652* (2013.01); *E04G 11/06* (2013.01); *E04G 17/06* (2013.01); *E04B 2002/867* (2013.01)

(58) Field of Classification Search
CPC ..... E04G 17/00; E04G 11/06; E04B 1/66; E04B 1/12; E04B 2/86; E04B 2/8641; E04B 2/8652; E04B 2/8635; E04B 2002/867; E04B 2002/8676; E04C 2/20
USPC ..... 52/426, 421, 309.1, 309.4, 309.12, 52/309.17, 425, 439; 249/191, 194, 195, 249/213, 216
See application file for complete search history.

(56) References Cited

U.S. PATENT DOCUMENTS 154,179 A 8/1874 Hubert
374,826 A 12/1887 Clarke
(Continued)

FOREIGN PATENT DOCUMENTS

CA 0574720 4/1959
CA 0957816 11/1974
(Continued)

OTHER PUBLICATIONS

Vector Corrosion Technologies Marketing Materials, 2005.
(Continued)

*Primary Examiner* — Mark Wendell
(74) *Attorney, Agent, or Firm* — Todd A. Rattray; Oyen Wiggs Green & Mutala LLP

(57) ABSTRACT

A formwork apparatus for forming a concrete structure comprises a plurality of elongated panels comprising connector components at their transverse edges for connecting to one another in edge-adjacent relationship. Each one of the elongated panels comprises an outer surface that extends between its transverse edges and an inner surface that extends between its transverse edges at a location inwardly spaced apart from the outer surface. The inner surface comprises one or more inwardly projecting convexities that extend between the transverse edges. The inwardly projecting convexities may comprise arcuate-shaped surfaces. The inwardly projecting convexities may comprise a plurality of transversely adjacent convexities. There may be brace elements that extend part way between or all the way between the outer and inner surfaces.

28 Claims, 33 Drawing Sheets

(51) Int. Cl.
*E04G 11/06* (2006.01)
*E04G 17/06* (2006.01)

(56) References Cited

U.S. PATENT DOCUMENTS 510,720 A 12/1893 Stewart, Jr.
820,246 A 5/1906 Nidds
999,334 A 8/1911 Pearson
1,035,206 A 8/1912 Lewen
1,080,221 A 12/1913 Jester
1,175,168 A 3/1916 Moulton
1,244,608 A 10/1917 Hicks
1,276,147 A 8/1918 White
1,345,156 A 6/1920 Flynn
1,423,879 A 7/1922 Potter
1,540,570 A 6/1925 Roberts
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,076,472 A 4/1937 London
2,164,681 A 7/1939 Fould
2,172,052 A 9/1939 Robbins
2,326,361 A 8/1943 Jacobsen
2,354,485 A 7/1944 Slaughter
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,063,122 A 11/1962 Katz
3,100,677 A 8/1963 Frank et al.
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A 12/1966 Bowden et al.
3,468,088 A 9/1969 Miller
3,545,152 A 12/1970 Knohl
3,555,751 A 1/1971 Thorgusen
3,588,027 A 6/1971 Bowden
3,682,434 A 8/1972 Boenig
3,769,769 A 11/1973 Kohl
3,788,020 A 1/1974 Gregori
3,822,557 A 7/1974 Frederick
3,886,705 A 6/1975 Cornland
3,951,294 A 4/1976 Wilson
3,991,636 A 11/1976 Devillers
4,023,374 A 5/1977 Colbert et al.
4,060,945 A 12/1977 Wilson
4,104,837 A 8/1978 Naito
4,106,233 A 8/1978 Horowitz
4,114,388 A 9/1978 Straub
4,180,956 A 1/1980 Gross
4,182,087 A 1/1980 Schall et al.
4,193,243 A 3/1980 Tiner
4,276,730 A 7/1981 Lewis
4,299,070 A 11/1981 Oltmanns et al.
4,332,119 A 6/1982 Toews
4,351,870 A 9/1982 English
4,383,674 A 5/1983 Fricker
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,606,167 A 8/1986 Thorne
4,695,033 A 9/1987 Imaeda et al.
4,703,602 A 11/1987 Pardo
4,731,964 A 3/1988 Phillips
4,731,971 A 3/1988 Terkl
4,742,665 A 5/1988 Baierl
4,808,039 A 2/1989 Fischer
4,856,754 A 8/1989 Yokota et al.
4,866,891 A 9/1989 Young
4,930,282 A 6/1990 Meadows
4,946,056 A 8/1990 Stannard
4,995,191 A 2/1991 Davis
5,014,480 A 5/1991 Guarriello et al.
5,028,368 A 7/1991 Grau
5,058,855 A 10/1991 Ward
5,078,360 A 1/1992 Spera
5,106,233 A 4/1992 Breaux
5,124,102 A 6/1992 Serafini
5,187,843 A 2/1993 Lynch
5,216,863 A 6/1993 Nessa et al.
5,243,805 A 9/1993 Fricker
5,247,773 A 9/1993 Weir
5,265,750 A 11/1993 Whiteley
5,292,208 A 3/1994 Berger
5,311,718 A 5/1994 Trousilek
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch
5,608,999 A 3/1997 McNamara
5,625,989 A 5/1997 Brubaker et al.
5,714,045 A 2/1998 Lasa et al.
5,729,944 A 3/1998 De Zen
5,740,648 A 4/1998 Piccone
5,747,134 A 5/1998 Mohammed et al.
5,791,103 A 8/1998 Coolman
5,824,347 A 10/1998 Serafini
5,860,262 A 1/1999 Johnson
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lanc
6,167,672 B1 1/2001 Okitomo
6,185,884 B1 2/2001 Myers et al.
6,189,269 B1 2/2001 De Zen
6,212,845 B1 4/2001 De Zen
6,219,984 B1 4/2001 Piccone
6,220,779 B1 4/2001 Warner et al.
6,247,280 B1 6/2001 Grinshpun et al.
6,286,281 B1 9/2001 Johnson
6,293,067 B1 9/2001 Meendering et al.
6,387,309 B1 5/2002 Kojima
6,405,508 B1 6/2002 Janesky
6,435,470 B1 8/2002 Lahham et al.
6,435,471 B1 8/2002 Piccone
6,438,918 B2 8/2002 Moore et al.
6,467,136 B1 10/2002 Graham
6,530,185 B1 3/2003 Scott et al.
6,550,194 B2 4/2003 Jackson et al.
6,588,165 B1 7/2003 Wright
6,622,452 B2 9/2003 Alvaro
6,691,976 B2 2/2004 Myers et al.
6,694,692 B2 2/2004 Piccone
6,832,456 B1 12/2004 Bilowol
6,866,445 B2 3/2005 Semler
6,935,081 B2 8/2005 Dunn et al.
7,320,201 B2 1/2008 Kitchen et al.
7,444,788 B2 11/2008 Morin et al.
7,818,936 B2 10/2010 Morin et al.

(56) References Cited

U.S. PATENT DOCUMENTS

| | | | |
|---|---|---|---|
| 8,074,418 | B2 | 12/2011 | Thiagarajan et al. |
| 8,485,493 | B2 | 7/2013 | Wells et al. |
| 8,707,648 | B2 | 4/2014 | Timko et al. |
| 8,769,904 | B1 | 7/2014 | Brandt et al. |
| 8,806,839 | B2 | 8/2014 | Zhou |
| 8,959,871 | B2 | 2/2015 | Parenti et al. |
| 2003/0005659 | A1 | 1/2003 | Moore, Jr. |
| 2003/0085482 | A1 | 5/2003 | Sincock et al. |
| 2003/0155683 | A1 | 8/2003 | Pietrobon |
| 2004/0010994 | A1 | 1/2004 | Piccone |
| 2004/0093817 | A1 | 5/2004 | Pujol Barcons |
| 2005/0016083 | A1 | 1/2005 | Morin et al. |
| 2005/0016103 | A1 | 1/2005 | Piccone |
| 2006/0179762 | A1 | 8/2006 | Thome et al. |
| 2006/0185270 | A1 | 8/2006 | Handley et al. |
| 2006/0213140 | A1 | 9/2006 | Morin et al. |
| 2007/0193169 | A1 | 8/2007 | Emblin |
| 2009/0120027 | A1 | 5/2009 | Amend |
| 2009/0229214 | A1 | 9/2009 | Nelson |
| 2009/0269130 | A1 | 10/2009 | Williams |
| 2010/0047608 | A1 | 2/2010 | Seccombe |
| 2010/0050552 | A1 | 3/2010 | David |
| 2010/0071304 | A1 | 3/2010 | Richardson et al. |
| 2010/0251657 | A1 | 10/2010 | Richardson et al. |
| 2011/0000161 | A1 | 1/2011 | Aub |
| 2011/0131914 | A1 | 6/2011 | Richardson et al. |
| 2011/0277410 | A1 | 11/2011 | Richardson |
| 2012/0056344 | A1 | 3/2012 | Richardson et al. |
| 2012/0121337 | A1 | 5/2012 | Richardson et al. |
| 2013/0081345 | A1 | 4/2013 | Sheehy |

FOREIGN PATENT DOCUMENTS

| | | | |
|---|---|---|---|
| CA | 1316366 | | 4/1993 |
| CA | 2097226 | | 11/1994 |
| CA | 2141463 | | 8/1996 |
| CA | 2070079 | | 6/1997 |
| CA | 2170681 | | 8/1997 |
| CA | 2218600 | | 6/1998 |
| CA | 2215939 | | 8/1999 |
| CA | 2226497 | | 10/1999 |
| CA | 2243905 | | 1/2000 |
| CA | 2255256 | | 1/2000 |
| CA | 2244537 | | 2/2000 |
| CA | 2418885 | | 8/2003 |
| CA | 2502343 | | 5/2004 |
| CA | 2502392 | | 5/2004 |
| CA | 2499450 | | 9/2005 |
| CA | 2577217 | | 1/2006 |
| CA | 2629202 | | 4/2008 |
| CA | 2716118 | A1 | 8/2008 |
| CA | 2681963 | | 10/2008 |
| CA | 2751134 | A1 | 12/2011 |
| CA | 2855742 | A1 | 5/2013 |
| CH | 317758 | | 1/1957 |
| CH | 669235 | A5 | 2/1989 |
| CN | 2529936 | | 1/2003 |
| DE | 1684357 | | 4/1967 |
| DE | 1812590 | | 6/1970 |
| DE | 2062723 | | 8/1972 |
| DE | 3003446 | | 8/1981 |
| DE | 3234489 | | 3/1984 |
| DE | 3727956 | | 5/1988 |
| DE | 29803155 | | 6/1998 |
| EP | 0025420 | | 3/1981 |
| EP | 0055504 | | 7/1982 |
| EP | 0141782 | | 5/1985 |
| EP | 0179046 | A2 | 4/1986 |
| EP | 0757137 | | 2/1997 |
| EP | 2169133 | A2 | 3/2010 |
| FR | 0507787 | | 7/1920 |
| FR | 1381945 | | 11/1964 |
| FR | 1603005 | | 4/1971 |
| FR | 2364314 | | 4/1978 |
| FR | 2535417 | | 5/1984 |
| FR | 2721054 | | 6/1994 |
| FR | 2717848 | | 9/1995 |
| FR | 2669364 | A1 | 3/2012 |
| GB | 137221 | | 1/1920 |
| GB | 779916 | | 7/1957 |
| GB | 1243173 | | 8/1971 |
| GB | 1253447 | | 11/1971 |
| GB | 2141661 | | 1/1985 |
| GB | 2205624 | | 12/1988 |
| JP | 05133028 | | 5/1993 |
| JP | 09041612 | | 2/1997 |
| JP | 2008223335 | | 9/2008 |
| SE | 206538 | | 8/1966 |
| WO | 8204088 | | 11/1982 |
| WO | 9500724 | | 1/1995 |
| WO | 9607799 | | 3/1996 |
| WO | 9635845 | | 11/1996 |
| WO | 9743496 | | 11/1997 |
| WO | 0163066 | | 8/2001 |
| WO | 0173240 | | 10/2001 |
| WO | 03006760 | | 1/2003 |
| WO | 2004088064 | | 10/2004 |
| WO | 2005/040526 | | 5/2005 |
| WO | 2008119178 | | 10/2008 |
| WO | 2009059410 | | 5/2009 |
| WO | 2009092158 | | 7/2009 |
| WO | 2010012061 | A1 | 2/2010 |
| WO | 2010037211 | | 4/2010 |
| WO | 2010078645 | | 7/2010 |
| WO | 2012003587 | | 1/2012 |
| WO | 2013075251 | | 5/2013 |
| WO | 2013102274 | | 7/2013 |
| WO | 2013102275 | | 7/2013 |
| WO | 2013177715 | | 12/2013 |
| WO | 2013188980 | | 12/2013 |

OTHER PUBLICATIONS

Vector Corrosion Technologies Marketing Materials, 2007.

Vector Corrosion Technologies Marketing Materials, 2008.

Digigraph Brochure, Building Systems using PVC extrusions and concrete, accessed online Jan. 2012.

Digigraph Guide, Digigraph Systems Inc., Installation Guide for the Digigraph Construction System Composed of PVC Extrusions and Concrete, accessed online Jan. 2012.

The Digigraph System, http://www.digigraph-housing.com/web/system.ht, accessed online Jan. 2012.

STAY-IN-PLACE FORMWORK WITH ANTI-DEFORMATION PANELS

RELATED APPLICATIONS

This application claims priority from U.S. application No. 61/563,594 filed on 24 Nov. 2011. U.S. application No. 61/563,594 is hereby incorporated herein by reference.

TECHNICAL FIELD

The technology disclosed herein relates to form-work systems for fabricating structures from concrete or other curable construction materials. Particular embodiments provide stay-in-place formwork panels, systems for modular stay-in-place formworks and methods for providing such modular stay-in-place formworks which include anti-deformation panels.

BACKGROUND

It is known to fabricate structural parts for building walls from concrete using modular stay-in-place forms. Examples of such modular stay in place forms include those described in US patent publication No. 2005/0016103 (Piccone) and PCT publication No. WO96/07799 (Sterling). A representative drawing depicting a partial form 28 according to one prior art system is shown in top plan view in FIG. 1. Form 28 includes a plurality of wall panels 30 (e.g. 30A, 30B, 30C, 30D), each of which has an inwardly facing surface 31A and an outwardly facing surface 31B. Each of panels 30 includes a terminal male T-connector component 34 at one of its transverse, longitudinally-extending edges (longitudinal being the direction into and out of the FIG. 1 page) and a terminal female C-connector component 32 at its opposing longitudinal edge. Male T-connector components 34 slide longitudinally into the receptacles of female C-connector components 32 to join edge-adjacent panels 30 to form a pair of substantially parallel wall segments (generally indicated at 27, 29). Depending on the needs for particular wall segments 27, 29, different panels 30 may have different transverse dimensions. For example, comparing panels 30A and 30B, it can be seen that panel 30A has approximately ¼ of the transverse length of panel 30B.

Form 28 includes support panels 36A which extend between, and connect to each of, wall segments 27, 29 at transversely spaced apart locations. Support panels 36A include male T-connector components 42 slidably received in the receptacles of female C-connector components 38 which extend inwardly from inwardly facing surfaces 31A or from female C-connector components 32. Form 28 comprises tensioning panels 40 which extend between panels 30 and support panels 36A at various locations within form 28. Tensioning panels 40 include male T-connector components 46 received in the receptacles of female C-connector components 38.

In use, form 28 is assembled by slidable connection of the various male T-connector components 34, 42, 46 in the receptacles of the various female C-connectors 32, 38. Liquid concrete is then introduced into form 28 between wall segments 27, 29. The concrete flows through apertures (not shown) in support panels 36A and tensioning panels 40 to fill the interior of form 28 (i.e. between wall segments 27, 29). When the concrete solidifies, the concrete (together with form 28) provide a structural component (e.g. a wall) for a building or other structure.

A problem with prior art systems is referred to colloquially as "pillowing". Pillowing refers to the outward deformation of wall panels 30 due to the weight and corresponding outward pressure generated by liquid concrete when it is introduced into form 28. Pillowing may be reduced to some degree by support panels 36A and tensioning panels 40 which connect to wall panels 30 at female C-connector components 38. Despite the presence of support panels 36A and tensioning panels 40 and their connection to wall panels 30 at connector components 38, wall panel 30 may still exhibit pillowing. By way of example, pillowing may occur in the regions of panels 30 between support panels 36A, tensioning panels 40 and their corresponding connector components 38. FIG. 2 schematically depicts the pillowing of a prior art wall panel 30 at regions 52A, 52B, 52C between support panels 36A, tensioning panels 40 and their corresponding connector components 38. The concrete (not explicitly shown) on the inside 54 of panel 30 exerts outward forces on panel 30 (as shown at arrows 56). These outward forces tend to cause deformation (or pillowing) of panel 30 at regions 52A, 52B, 52C. In addition to the pillowing at individual regions 52A, 52B, 52C, the outward force on panel 30 can cause outward (in direction 56) pillowing of the entire transverse width of panel 30 (i.e. between the transverse edges of panel 30).

Another problem with prior art systems is referred to colloquially as "bellying". Bellying refers to another type of outward deformation of wall panels due to the weight and corresponding pressure generated by liquid concrete when it is introduced into form 28. Bellying typically occurs near the middle of the vertical dimension of a wall formed from concrete. In contrast to pillowing, which creates convexities along the transverse dimensions of panels 30 (as shown in FIG. 2), bellying creates convexities along the vertical dimensions of panels 30.

Deformation of panels due to the weight of liquid concrete can lead to a number of related problems including, without limitation, unsightly wall appearance, panel fatigue, reduction in structural integrity and/or the like.

There is accordingly a general desire to provide modular stay-in-pace formwork components that minimize and/or otherwise reduce (in relation to the prior art) outward deformation of panels under the weight of liquid concrete.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a formwork apparatus for forming a concrete structure comprising a plurality of elongated panels comprising connector components at their transverse edges for connecting to one another in edge-adjacent relationship. Each one of the elongated panels comprises an outer surface that extends between its transverse edges and an inner surface that extends between its transverse edges at a location inwardly spaced apart from the outer surface. The inner surface comprises one or more inwardly projecting convexities that extend between the transverse edges. The inwardly projecting convexities may comprise arcuate-shaped surfaces. The inwardly projecting convexities may comprise a plurality of transversely adjacent convexities. There may be brace elements that extend part way between, or all the way between, the outer and inner surfaces.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

In drawings which illustrate non-limiting embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Particular embodiments of the invention provide a formwork apparatus for forming a concrete structure comprising a plurality of elongated panels comprising connector components at their transverse edges for connecting to one another in edge-adjacent relationship. Each one of the elongated panels comprises an outer surface that extends between its transverse edges and an inner surface that extends between its transverse edges at a location inwardly spaced apart from the outer surface. The inner surface comprises one or more inwardly projecting convexities that extend between the transverse edges. The inwardly projecting convexities may comprise arcuate-shaped surfaces. The inwardly projecting convexities may comprise a plurality of transversely adjacent convexities. There may be brace elements that extend part way between, or all the way between, the outer and inner surfaces.

Figure 3A:
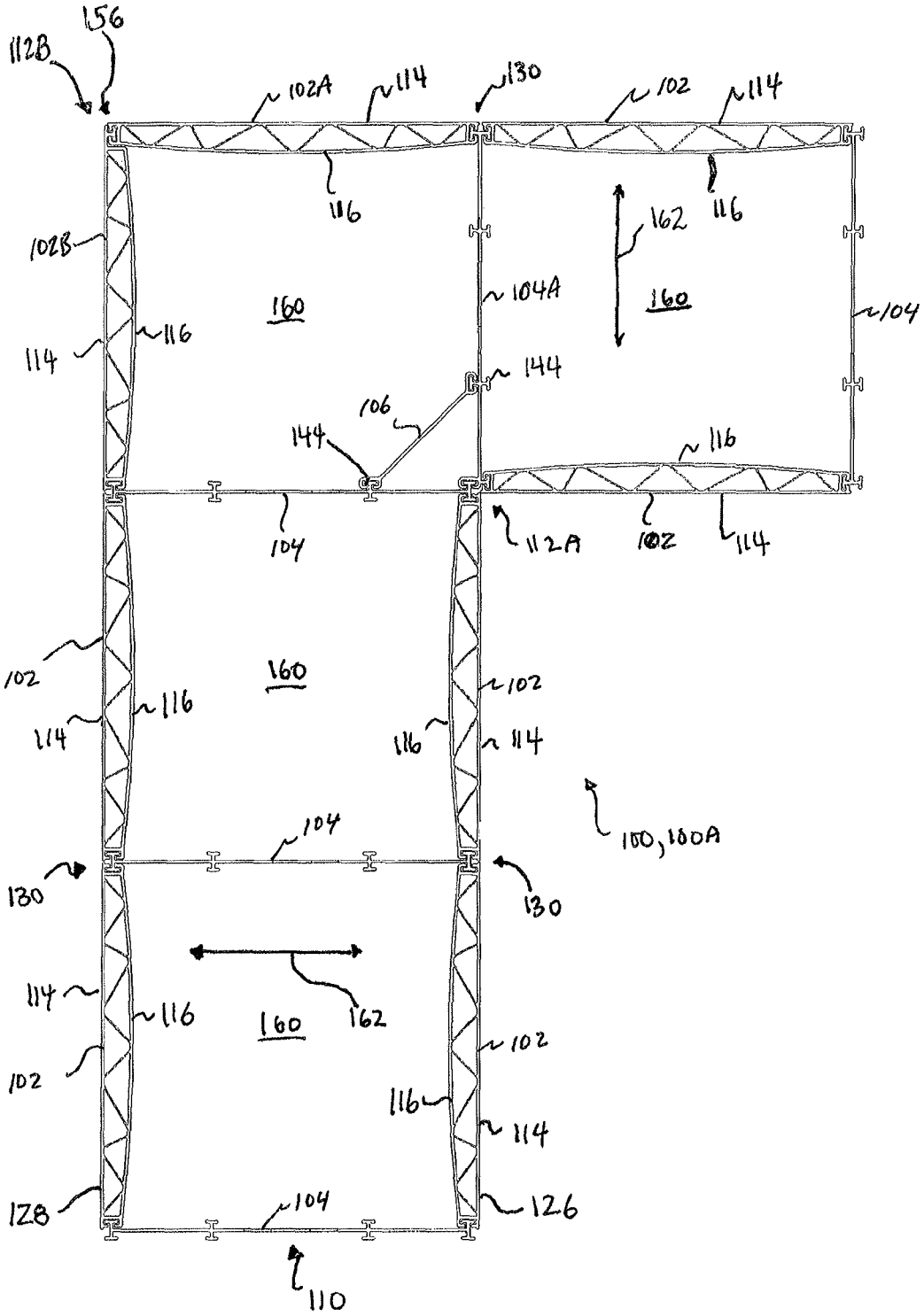
FIG. 3A is a top plan view of a portion of a modular stay-in-place formwork according to a particular embodiment.

FIG. 3A is a top plan view of a portion 100A of a formwork 100 according to a particular embodiment of the invention. Formwork portion 100A may be incorporated into a formwork 100 which may be used to fabricate a structure. Examples of formworks 100 into which formwork portion 100A may be incorporated are described, for example, in U.S. Pat. No. 6,435,471 filed on 16 Oct. 1998 and entitled MODULAR FORMWORK ELEMENTS AND ASSEMBLY, which is hereby incorporated herein by reference.

Figure 3B:
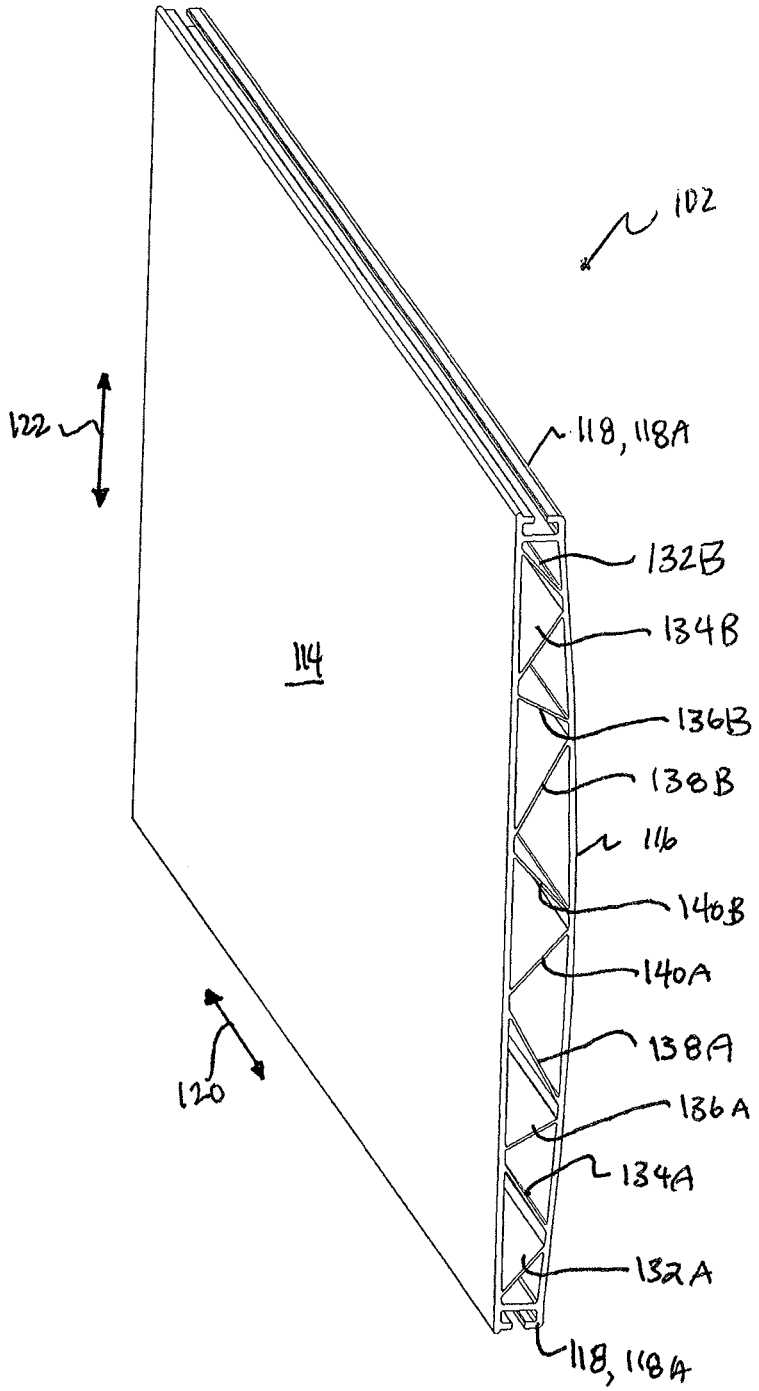
FIGS. 3B, 3C and 3D are respectively isometric views of a panel, a support member and a tensioning member of the FIG. 3A formwork.
Figure 3C:
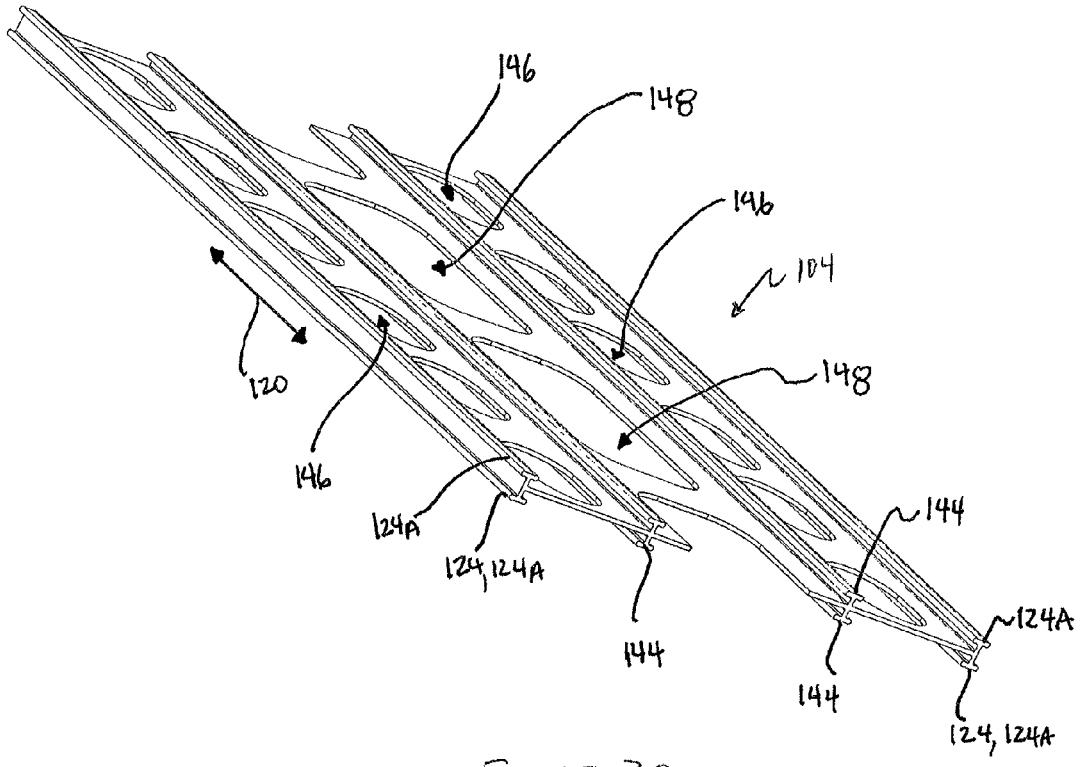
Figure 3D:
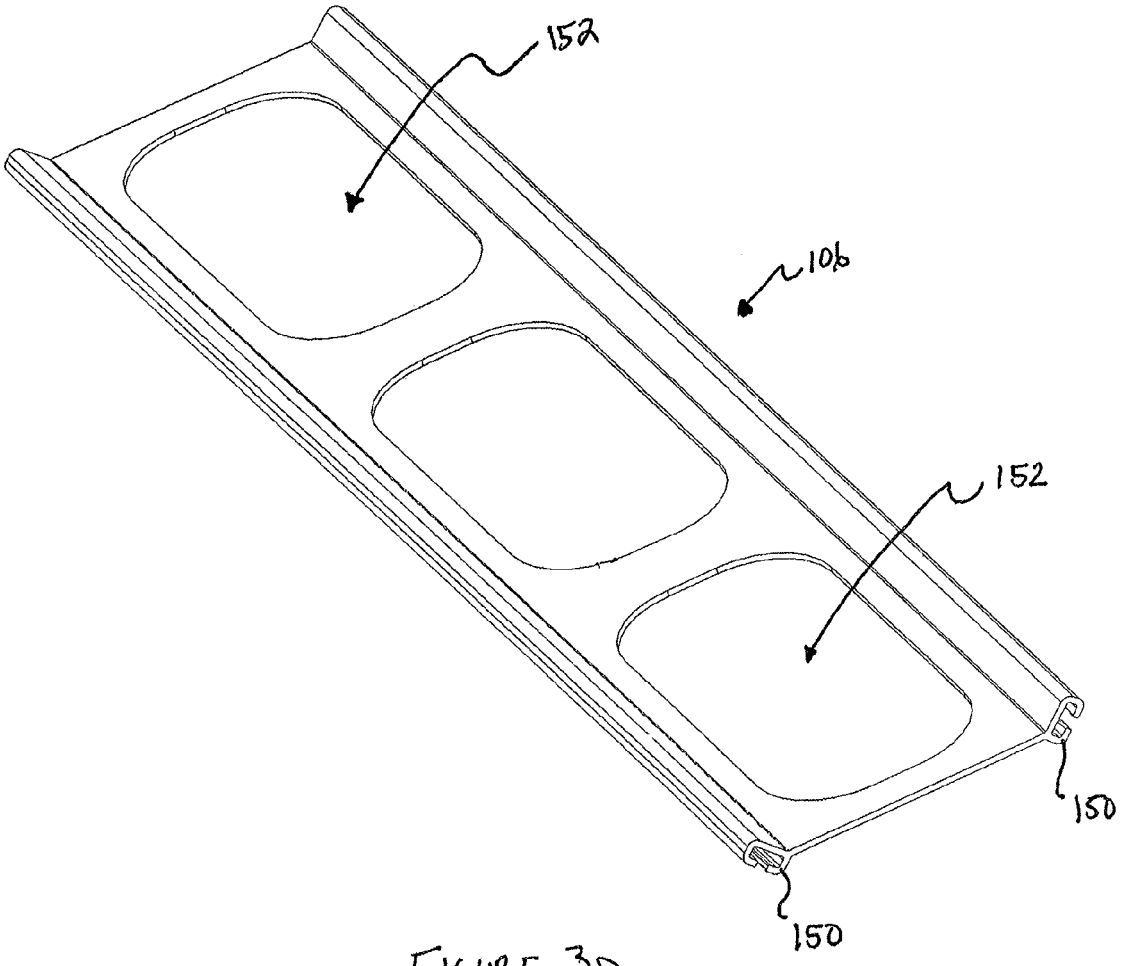

In the illustrated embodiment of FIG. 3A, formwork portion 100A defines a portion of a wall 110 comprising an inside corner 112A and an outside corner 112B. Formwork portion 100A includes panels 102, 102A, 102B (generally, panels 102), which are elongated in a longitudinal direction (i.e. the direction into and out of the page in FIG. 3A). FIG. 3B is an isometric view of a panel 102 in isolation. Formwork portion 100A also includes support members 104, 104A (generally, support members 104) and optional tensioning members 106, which are also elongated in the longitudinal direction. FIGS. 3C and 3D respectively depict isometric views of support member 104 and tensioning member 106 in isolation.

Panels 102, support members 104 and tensioning members 106 may be fabricated from a lightweight and resiliently and/or elastically deformable material (e.g. a suitable plastic) using an extrusion process. By way of non-limiting example, suitable plastics include: poly-vinyl chloride (PVC), acrylonitrile butadiene styrene (ABS) or the like. In other embodiments, panels 102, support members 104 and/or tensioning members 106 may be fabricated from other suitable materials, such as steel or other suitable alloys, for example. Although extrusion is the currently preferred technique for fabricating panels 102, support members 104 and tensioning members 106, other suitable fabrication techniques, such as injection molding, stamping, sheet metal fabrication techniques or the like may additionally or alternatively be used.

Panels 102 are elongated in longitudinal directions 120 and extend in transverse directions 122. In the illustrated embodiment, panels 102 have a substantially similar transverse cross-section along their entire longitudinal dimension, although this is not necessary. In general, panels 102 may have a number of features which differ from one another as explained in more particular detail below. The transverse edges 118 of panels 102 comprise connector components 118A which are connected to complementary connector components 124A at the inner and outer edges 124 of support members 104 so as to connect panels 102 in edge-adjacent relationship and to thereby provide wall segments 126, 128 of formwork 100. Support members 104 connect in this manner to an edge-adjacent pair of panels 102 at both inner and outer edges 124 of support members 104 to provide connections 130. In the illustrated embodiment, connector components 118A of panels 102 comprise female C-shaped connector components 118A which are complementary to male T-shaped connector components 124A of support members 104. In this manner, male T-shaped connector components 124A may be slidably received in female C-shaped connector components 118A by relative longitudinal movement between support members 104 and panels 102.

In other embodiments, connector components 118A, 124A may be different than those shown in the illustrated embodiment and may connect to one using techniques other than relative sliding, such as, by way of non-limiting example, deformable "snap-together" connections, pivotal connections, push on connections and/or the like. In some embodiments, panels 102 may be provided with male connector component and support members 104 may comprise female connector components.

Each of the panels 102 of the illustrated embodiment, comprises an outer surface 114 which faces an exterior of its associated formwork wall segment 126, 128 and an inner surface 116 which faces an interior of its associated formwork wall segment 126, 128. In the illustrated embodiment, outer surface 114 is substantially flat, although in other embodiments, outer surface 114 may be provided with desired shapes (e.g. corrugation or the like). Inner surface 116, however, has an arcuate shape as it extends between transverse edges 118 of panel 102 to provide an inward facing surface which is convex between transverse edges 118.

Figure 3E:
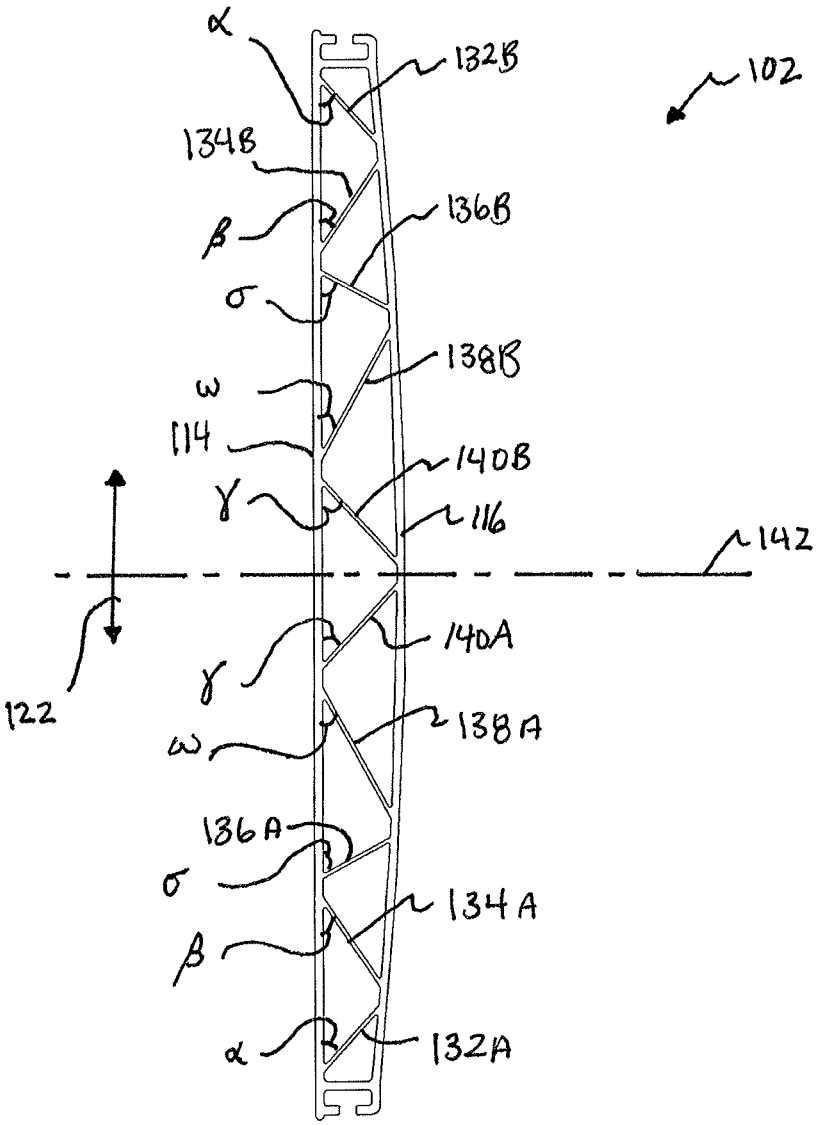
FIG. 3E is a top plan view of a panel of the FIG. 3A formwork.

Extending between outer surface 114 and inner surface 116, panel 102 comprises a plurality of brace elements 132A, 132B, 134A, 134B, 136A, 136B, 138A, 138B, 140A, 140B. As best seen in the top plan view of FIG. 3E, brace elements 132A, 132B, 134A, 134B, 136A, 136B, 138A, 138B, 140A, 140B are oriented at non-orthogonal angles to both outer surface 114 and inner surface 116. In the illustrated embodiment, all of brace elements 132A, 132B, 134A, 134B, 136A, 136B, 138A, 138B, 140A, 140B in any one panel 102 are non-parallel with one another. In the illustrated embodiment (as shown best in FIG. 3E), brace elements 132A, 132B, 134A, 134B, 136A, 136B, 138A, 138B, 140A, 140B are oriented to be symmetrical about a notional transverse mid-plane 142—i.e. more particularly:

the transversely outermost pair of brace elements 132A, 132B have orientations that are mirror images of one another relative to mid-plane 142 and are oriented with the same interior angle $\alpha$ relative to outer surface 114;

the second transversely outermost pair of brace elements 134A, 134B have orientations that are mirror images of one another relative to mid-plane 142 and are oriented with the same interior angle $\beta$ relative to outer surface 114;

the third transversely outermost pair of brace elements 136A, 136B have orientations that are mirror images of one another relative to mid-pane 142 and are oriented with the same interior angle $\sigma$ relative to outer surface 114;

the fourth transversely outermost pair of brace elements 138A, 138B have orientations that are mirror images of one another relative to mid-pane 142 and are oriented with the same interior angle $\omega$ relative to outer surface 114;

the transversely innermost pair of brace elements 140A, 140B have orientations that are mirror images of one another relative to mid-plane 142 and are oriented with the same interior angle $\gamma$ relative to outer surface 114.

This shape of outer and inner surfaces 114, 116 and the orientations of brace elements 132A, 132B, 134A, 134B, 136A, 136B, 138A, 138B, 140A, 140B can reduce deformation due to the weight of concrete (e.g. pillowing and/or bellying) in panel 102 as explained in more detail below. It will be appreciated that panel 102 of the illustrated embodiment comprises five pairs of brace elements 132A, 132B, 134A, 134B, 136A, 136B, 138A, 138B, 140A, 140B that are symmetrical with respect to notional mid-plane 142, but that in other embodiment, panels may comprise other numbers of pairs of symmetrical brace elements.

Figure 3F:
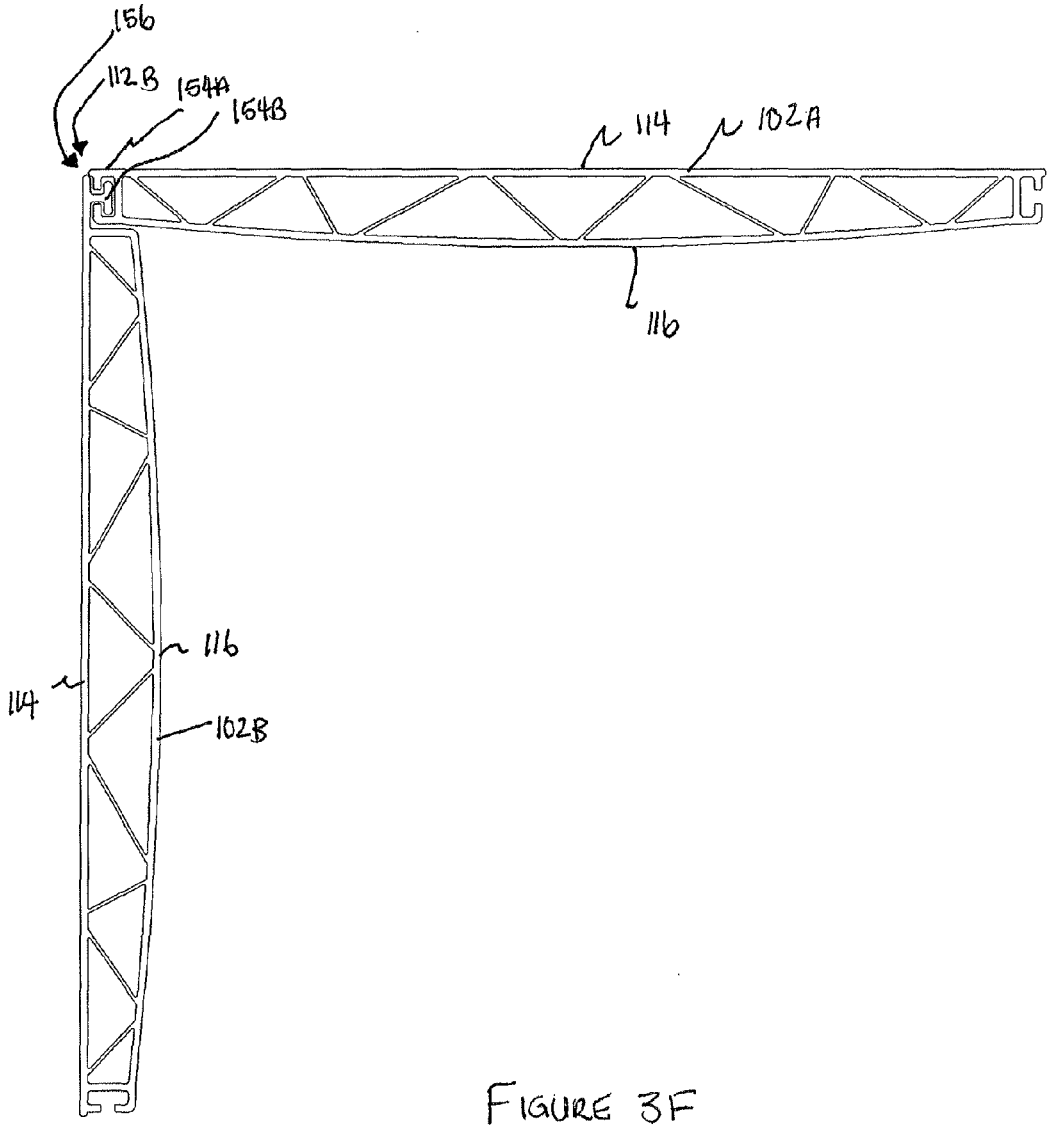
FIGS. 3F and 3G are respectively top plan views of an outside and inside corner of the FIG. 3A formwork.

In the illustrated embodiment, a pair of slightly different panels 102A, 102B are used to provide outside corner 112B. FIG. 3F shows a magnified top plan view of outside corner 112B and panels 102A, 102B. Panels 102A, 102B respectively comprise complementary connector components 154A, 154B which connect to one another to provide outside corner connection 156 wherein panels 102A, 102B connect directly to one another (rather than through a support member 104). In the illustrated embodiment, connector components 154B of panel 102B comprise T-shaped male connector components 154B that may be slidably received in complementary C-shaped female connector components 154A of panel 102A. This is not necessary. In other embodiments, connector components 154A, 154B of panels 102A, 102B may comprise any of the types of connector components described above in relation to connector components 118A, 124A. While outside corner 112B is shown as a 90° (orthogonal corner), this is not necessary. Those skilled in the art will appreciate that panels 102A, 102B could be modified to provide an outside corner having a different angle. In other respects, panels 102A, 102B are substantially similar to panels 102. Elsewhere in this description, references to panels 102 should be understood to include panels 102A, 102B where appropriate.

Support members 104 of the illustrated embodiment may comprise optional additional connector components 144 for connecting to optional tensioning members 106. In the illustrated embodiment, connector components 144 comprise T-shaped male connector components 144 that may be slidably received in complementary C-shaped female connector components 150 of tensioning members 106. This is not necessary. In other embodiments, connector components 144, 150 of support members 104 and tensioning members 106 may comprise any of the types of connector components described above in relation to connector components 118A, 124A. Support members 104 comprise a number of apertures 146, 148 which permit a flow of liquid concrete therethrough. Similarly, tensioning members 106 comprise apertures 152 which permit a flow of liquid concrete therethrough.

Figure 3G:
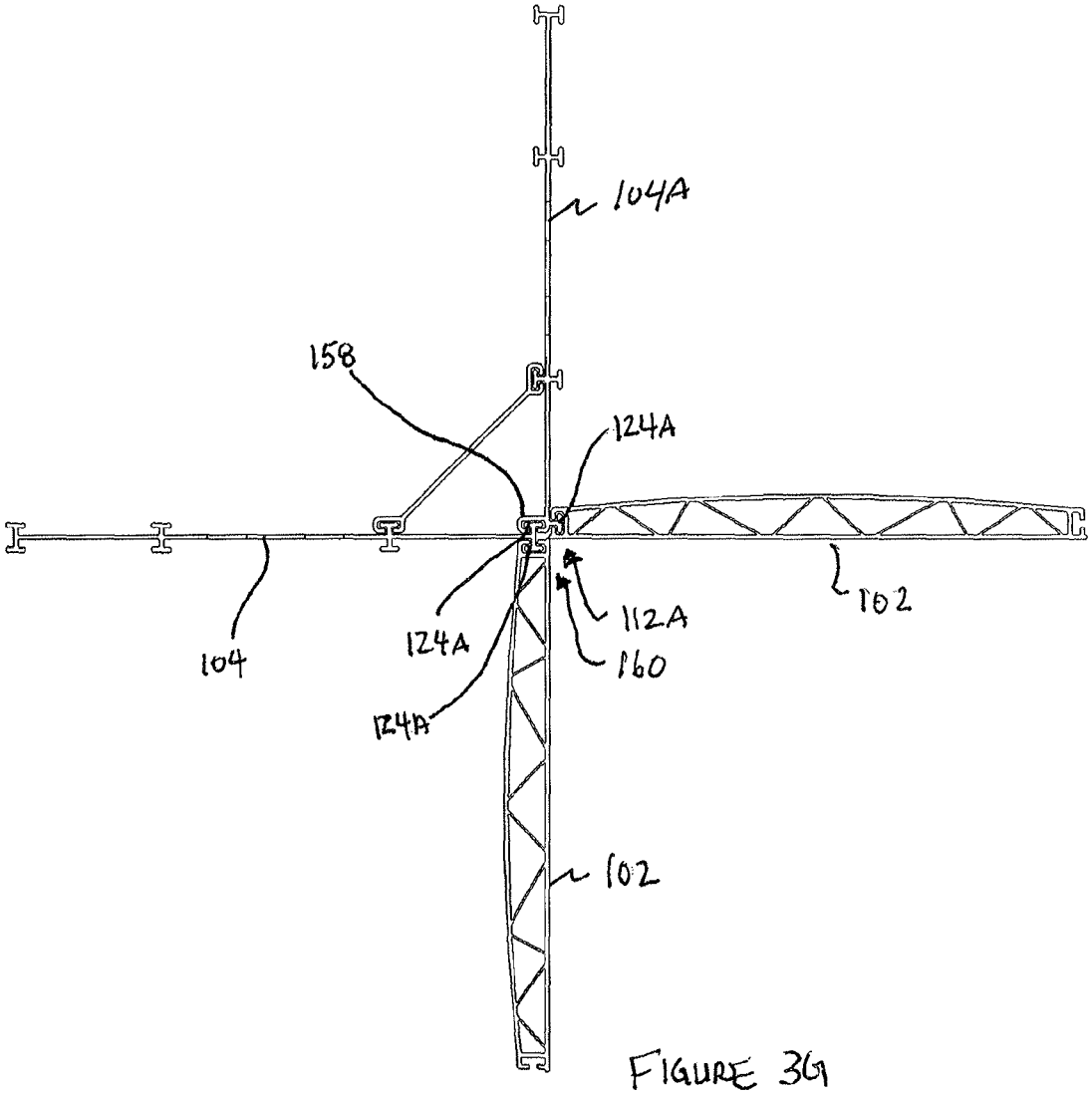

In the illustrated embodiment, a slightly different support member 104A is used to provide inside corner 112A. FIG. 3G shows a magnified top plan view of inside corner 112A and support member 104A. Support member 104A comprises, at one of its ends, a first connector component 124A that is the same as those discussed above for connecting to a complementary connector component 118A at a transverse edge of a panel 102 and a second connector component 158 shaped and oriented for connection to a complementary connector component 124A on an orthogonally oriented support member 104. An orthogonal panel 102 may then connect to the other connector component 124A of the orthogonal support member 104. In this manner, a connection 160 is used to provide an inside corner 112A, wherein connection 160 comprises a pair of orthogonally connected support members 104, 104A and a pair of orthogonal panels 102 respectively connected to one of orthogonal support members 104, 104A. In the illustrated embodiment, connector component 158 of support member 104A comprises a C-shaped female connector component 158 for connecting to a complementary T-shaped male connector component 124A of the orthogonal support member 104. This is not necessary. In other embodiments, connector components 158, 124A of support members 104A, 104 may comprise any of the types of connector components described above in relation to connector components 118A, 124A. While inside corner 112A is shown as a 90° (orthogonal corner), this is not necessary. Those skilled in the art will appreciate that support member 104A could be modified to provide an inside corner having a different angle. In other respects, support member 104A is substantially similar to support member 104. Elsewhere in this description, references to support member 104 should be understood to include support member 104A, where appropriate.

Figure 1:
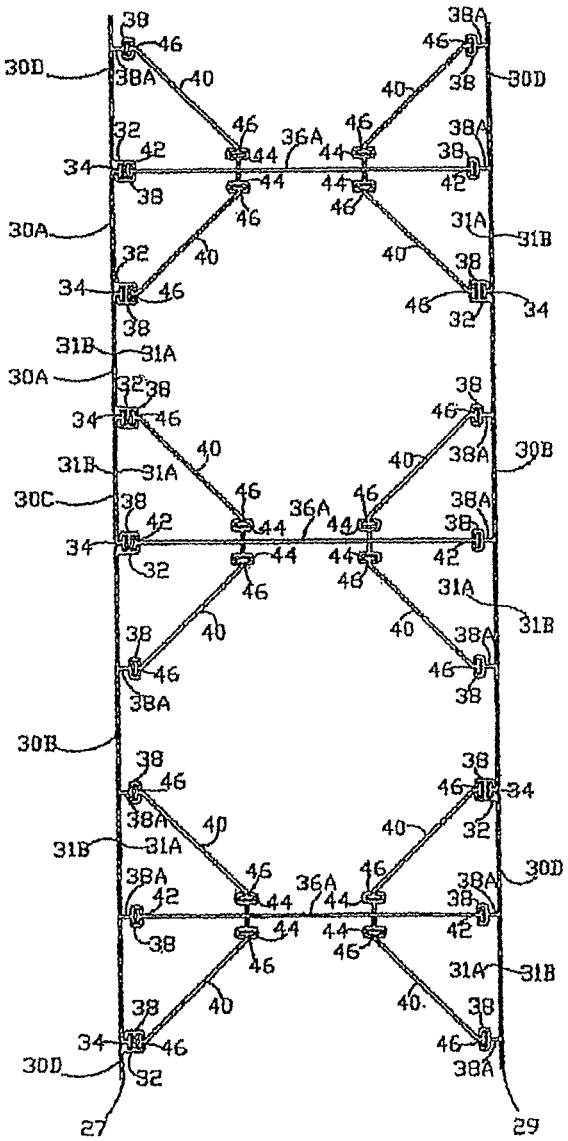
PRIOR ART FIGURE 1
FIG. 1 is a top plan view of a portion of a prior art modular stay-in-place formwork.
Figure 2:
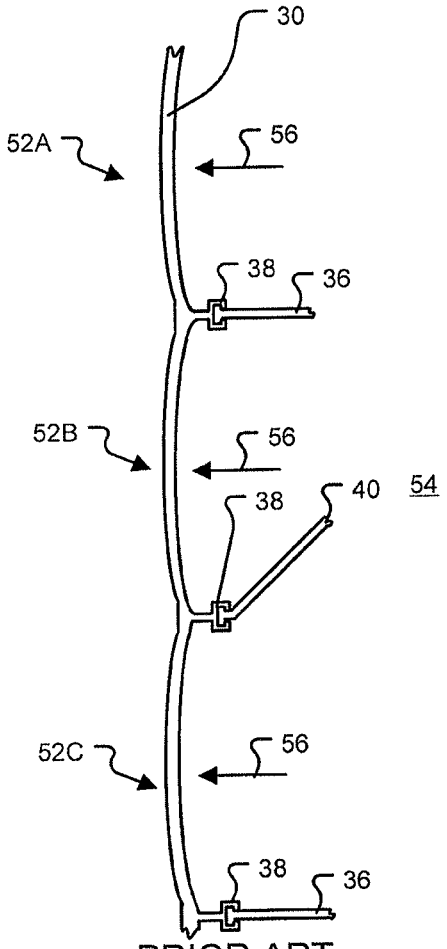
PRIOR ART FIGURE 2
FIG. 2 is a magnified schematic partial plan view of the FIG. 1 formwork, showing pillowing in various regions of a wall panel.

In the illustrated embodiment, tensioning member 106 is also used to help provide strength to inside corner 112A by connecting between connector components 144 of the orthogonal pair of support members 104, 104A. In other embodiments, tensioning member 106 is not required. In the illustrated embodiment, tensioning members 106 are not used in straight wall segments 126, 128 of formwork 100. This is not necessary, however. In other embodiments, inner surfaces 116 of panels 102 may be provided with suitable connector components, so that tensioning members 106 may be connected between support members 104 and panels 102—e.g. in a manner similar to tensioning members 40 connecting between support members 36 and panels 30 (FIG. 1) and in a manner similar to the "retaining elements" described in U.S. Pat. No. 6,435,471.

In operation, formwork 100 is assembled as describe above by: connecting panels 102 in edge-adjacent relationships using connections 130 between edge-adjacent panels 102 and corresponding support members 104; connecting panels 102A, 102B to provide any outside corners 112B; and connecting support members 104, 104A, panels 102 and optionally tensioning members 106 to one another to provide any inside corners 112A. Ends of wall segments (e.g. wall segments 126, 128) may be finished with end panels (not shown) which may be similar to support members 104, except without apertures 146, 148 and with connector components 124A, 144 on one side only. In other embodiments, such end panels are not required and ends of wall segments may be finished with conventional removable formwork components (e.g. reinforced plywood). Once formwork 100 is assembled, concrete (or some other suitable curable construction material) is introduced into an interior 160 of formwork 100—e.g. between inner surfaces 116 of opposing panels 102 of opposing formwork wall segments 126, 128. Pressure caused by the weight of the liquid concrete in interior region 160 will exert outward force on inner surfaces 116 of panels 102—for example in the directions indicated by arrows 162.

However, the configuration of panels 102 (including the shape of inner surface 116 and the orientations of brace elements 132A, 132B, 134A, 134B, 136A, 136B, 138A, 138B, 140A, 140B) may tend to reduce the deformation of panels 102 (or at least the deformation of outer surfaces 114 of panels 102) relative to that of prior art panels. More particularly, the convex (and arcuate convex) shape of inner surface 116 may form an arcuate quasi-truss configuration which tends to redirect outward forces to the transverse edges of panels 102, but since panels 102 are held firmly by support members 104 at their transverse edges, this redirection of outward forced may result in relatively little deformation of outer surfaces 114 of panels 102. Additionally, within panels 102 (i.e. between inner surface 116 and outer surface 114), adjacent brace elements 132A, 132B, 134A, 134B, 136A, 136B, 138A, 138B, 140A, 140B themselves have transverse cross-sections that are triangular in nature and provide a series of transversely-adjacent longitudinally-extending truss configurations. In addition, the non-parallel, non-orthogonal and angularly diverse orientation of brace elements 132A, 132B, 134A, 134B, 136A, 136B, 138A, 138B, 140A, 140B may tend to re-direct outward forces received on inner surfaces 116 so that such forces become oriented relatively more transversely when they are received in outer surfaces 114. However, because of the non-parallel nature of brace elements 132A, 132B, 134A, 134B, 136A, 136B, 138A, 138B, 140A, 140B, the redirection of these forces are at non-parallel orientations. Further, inner surfaces 116 may be able to deform into the spaces between the contact regions of brace elements 132A, 132B, 134A, 134B, 136A, 136B, 138A, 138B, 140A, 140B). Another advantage of brace elements 132A, 132B, 134A, 134B, 136A, 136B, 138A, 138B, 140A, 140B is that they may provide surface 114 with strength against deformation caused by any external force oriented toward interior 160.

In addition to the truss like characteristics of outer surfaces 114, inner surfaces 116 and brace elements 132A, 132B, 134A, 134B, 136A, 136B, 138A, 138B, 140A, 140B of panels 102, these features may also provide some insulating properties which may reduce the rate of transfer of heat across panels 102 relative to prior art panels. In some instates, the spaces between outer surfaces 114, inner surfaces 116 and brace elements 132A, 132B, 134A, 134B, 136A, 136B, 138A, 138B, 140A, 140B of panels 102 may be filled with insulation which may further enhance this insulation effect.

Once introduced into interior 160 of formwork 100, the concrete (or other suitable curable construction material) is permitted to solidify. The result is a structure (e.g. a wall) that has its surfaces covered by stay-in-place formwork 100 (e.g. panels 102).

A number of modifications may be provided to formwork 100 and, more particularly, to panels 102. A number of such modifications are described below.

Figure 4A:
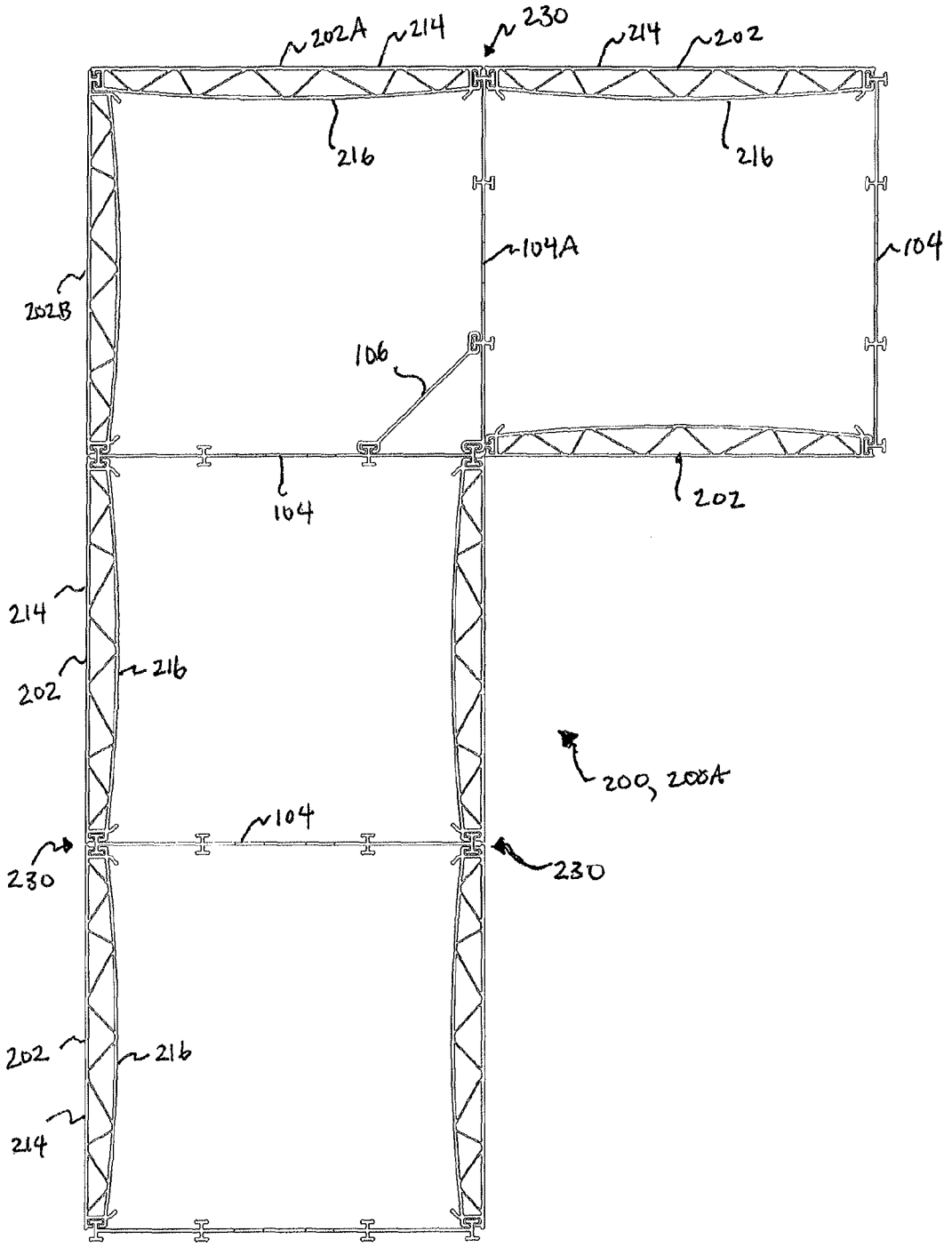
FIG. 4A is a top plan view of a portion of a modular stay-in-place formwork according to a particular embodiment.

FIG. 4A is a top plan view of a portion 200A of a formwork 200 according to a particular embodiment of the invention. Formwork portion 200A and formwork 200 are similar in many respects to formwork portion 100A and formwork 100 described above and similar reference numbers are used to refer to similar features, except that features of formwork portion 200A and formwork 200 are referred to using reference numbers preceded by the numeral "2" whereas features of formwork portion 100A and formwork 100 are referred to using reference numbers preceded by the numeral "1".

Formwork 200 includes support members 104, 104A and optional tensioning member 106 that are substantially identical to those described above for formwork 100. Formwork 200 also comprises panels 202, 202A, 202B (generally, panels 202) connected (through support members 104) to one another in edge-adjacent relationship at connections 230. Panels 202 differ slightly from panels 102 as described in more detail below.

Figure 4B:
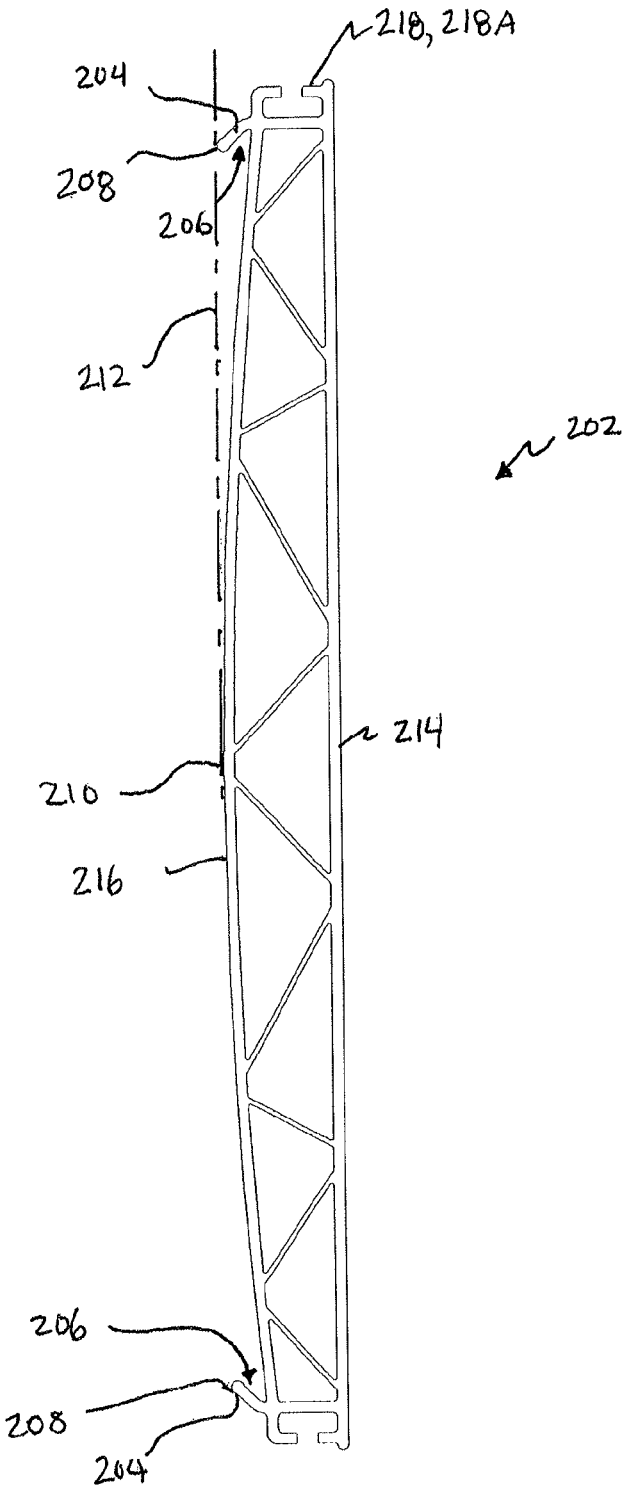
FIG. 4B is a top plan view of a panel of the FIG. 4A formwork.
Figure 4C:
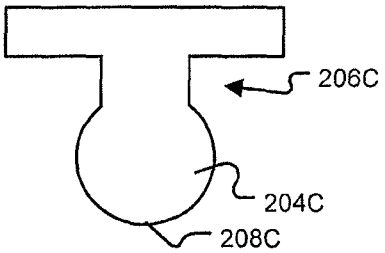
FIGS. 4C-4G are transverse cross-sectional views of anchor components according to other embodiments.
Figure 4D:
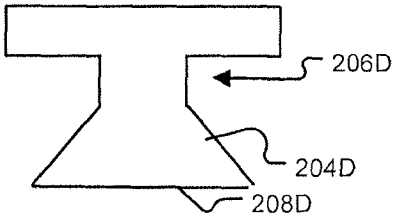
Figure 4E:
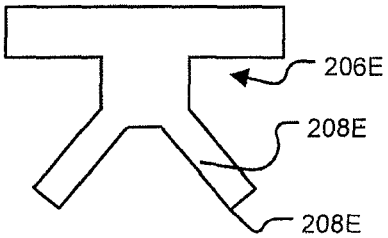
Figure 4F:
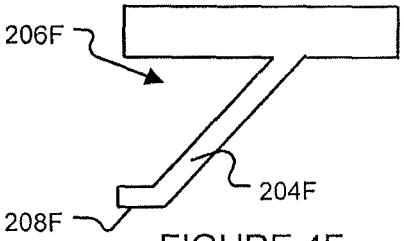
Figure 4G:
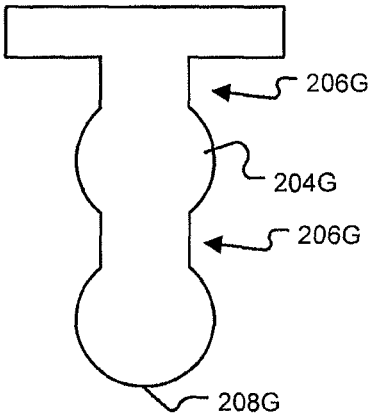

FIG. 4B is a top plan view of a panel 202 of formwork 200. In many respects, panel 202 is similar to panel 102 described herein. Panel 202 differs from panel 102 in that panel 202 comprises a plurality (e.g. 2 in the illustrated embodiment) of anchor components 204 which project inwardly from inner surface 216 of panel 202. In other embodiments, panel 202 may be provided with different numbers of anchor components 204 which may be spaced apart from one another along the transverse dimension of panel 202. Anchor components 204 may be longitudinally co-extensive with panel 202—i.e. anchor components 204 may extend into an out of the page of FIG. 4B (the longitudinal direction) and may be co-extensive with panel 202 in this longitudinal dimension. This is not necessary, however, and anchor components 204 may have different longitudinal extensions that that of panel 202. In addition to extending inwardly and longitudinally, anchor components 204 may extend transversely to provide one or more anchoring features 206. Anchoring features 206 may comprise one or more concavities between portions of anchor components 204 and/or inner surface 216 into which concrete may flow when the concrete is in liquid form to anchor panel 202 to the concrete when the concrete solidifies.

In addition to providing anchoring features 206, anchor components 204 may be sized and/or shaped to permit stacking of panels 202 for storage and shipping. More particularly, anchor components 204 may be sized and/of shaped such that the innermost extent 208 of anchor components 204 is co-planar with an apex 210 of the convexity of inner surface 216 in a plane substantially parallel to outer surface 214. For example, as shown in FIG. 4B, there is a notional plane 212 that is: parallel to outer surface 214; tangential to apex 210, or otherwise contacts inner surface 216 at only its innermost extent); and tangential to innermost extent 208 of anchor components 204, or otherwise contacts anchor components 204 only at their innermost extents 208. With anchor components 204 having this size/shape feature, panels 202 having convex inner surfaces 216 may be conveniently stacked on top of one another such that anchor components 204 and apex 210 of inner surface 216 of one panel 202 rest adjacent outer surface 214 of an adjacent panel 202. In other embodiments, stacking may be facilitated by making anchoring components extend inwardly beyond apex 210, so that panels stack on the innermost extents 208 of a plurality of anchor components 204.

Referring to FIG. 4A, it may be observed that panel 202A has one of its anchor components 204 removed. Panel 202A may be fabricated with only one anchor component 204, or one of the anchor components 204 of panel 202A may be removed. In embodiments, where it is desired to remove one of anchor components 204 from panel 202A, such anchor component 204 can be made in a "break-away" fashion, so that it is easily removable by hand, although this is not necessary. In other respects, panel 202 may be similar to panel 102 described herein. But for the addition of anchor components 204, corner panels 202A, 202B may be similar to corner panels 102A, 10B described herein.

Anchor components 204 may be varied in a number of ways while still providing anchoring features 206 and innermost extents 208 having the features described above. FIGS. 4C-4G respectively depict anchor components 204C-204G according to other embodiments. Each of anchor components 204C-204G could be use with panel 202. Each of anchor components 204C-204G provide corresponding anchoring features 206C-206G and have corresponding innermost extents 208C-208G having the features of anchoring features 206 and innermost extents 208 described above.

Figure 5A:
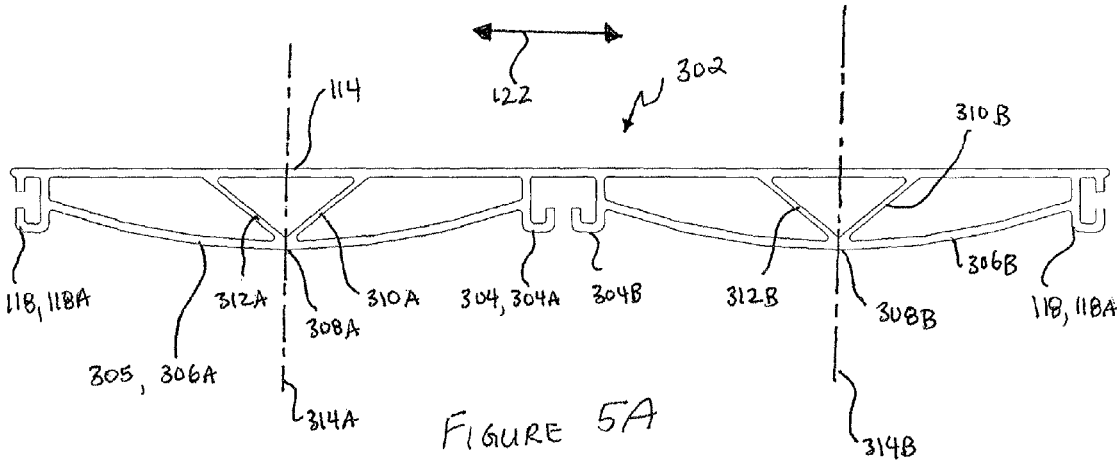
FIGS. 5A-5J are transverse cross-sectional views of panels which may be used with the formwork of FIG. 3A according to other embodiments.

FIG. 5A is a transverse cross-sectional view of a panel 302 which may be used with formworks 100, 200 of FIGS. 3A and 4A. In many respects, panel 302 is similar to panel 102 described above and similar features are referred to using similar reference numbers. Panel 302 differs from panel 102 in that panel 302 comprises an inner surface 305 comprising a plurality (e.g. 2 in the illustrated embodiment) arcuate inner-surface convexities 306A, 306B (collectively, inner-surface convexities 306) where each transversely adjacent pair of convexities 306 is separated by connector components 304A, 304B (collectively, connector components 304). Connector components 304 are complementary to connector components 124A on the inner and outer edges 124 of support members 104, such that when used to provide a formwork, panels 302 may optionally be connected to additional support members 104 at one or more locations away from transverse edges 118 of panels 302. In the illustrated embodiment, interior connector components 304 comprise a pair of J-shaped female connector components which slidably receive complementary pair of T-shaped male connector components 124A of support members 104. This is not necessary. In other embodiments, interior connector components 304 and complementary connector components 124A may comprise any of the types of connector components described above in relation to connector components 118A, 124A.

In the illustrated embodiment, panel 302 comprises one set of interior connector components 304 between a corresponding pair of inner-surface convexities 306. It will be appreciated, however, that panels may be provided with different numbers (e.g. pluralities) of sets of connector components 304 between corresponding pairs of adjacent inner-surface convexities 306. The additional connection(s) to support member(s) 104 at locations away from the transverse edges of panels 302 may provide greater strength to formworks constructed using panels 302 or may permit panels 302 to be provided with greater transverse widths (e.g. in direction 122) while providing the same strength and may thereby help to further reduce panel deformation.

Each of inner-surface convexities 306 is similar to inner surface 116 of panel 102 described above and comprises an apex 308A, 308B (collectively, apexes 308). Inner-surface convexities 306 differ from inner surface 116 of panel 102 in that each of inner surface convexities only extent partially across the transverse width of panel 302 (e.g. between edge 118 and interior connector component 304 in the illustrated embodiment). Panel 302 also comprises brace elements 310A, 310B, 312A, 312B (collectively, brace elements 310, 312) which extend between outer surface 114 and each of inner-surface convexities 306 at angles that are non-orthogonal to outer surface 114 and non-parallel with one another. Brace elements 310, 312 of panel 302 differ from the brace elements of panel 102 in that each set of brace elements 310, 312 is symmetric about a notional plane 314A, 314B (collectively, notional planes 314) that corresponds to (and extends through) the apex 308 of its corresponding inner surface convexity 306. In the illustrated embodiment, panel 302 comprises a symmetric pair of brace elements 310, 312 for each inner-surface convexity 306. In other embodiments, however, panel 302 may comprise any suitable number of symmetric pairs of brace elements for each inner-surface convexity.

In other respects, panel 302 may be similar to panel 102 described above.

Figure 5B:
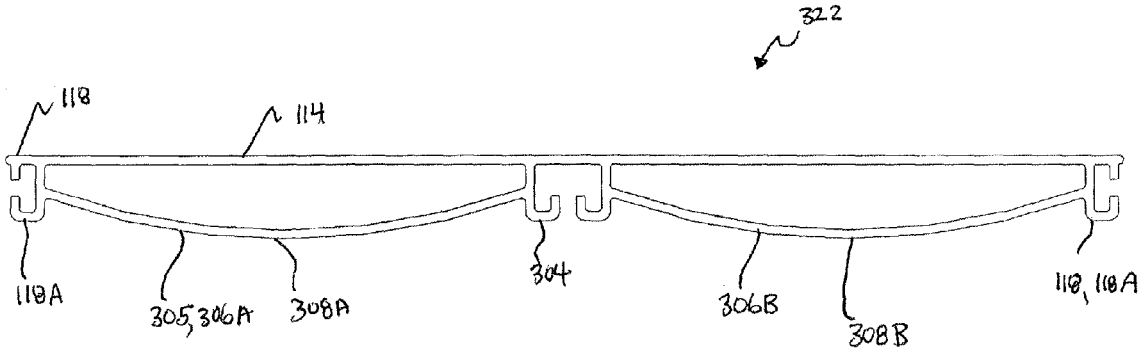

FIG. 5B is a transverse cross-sectional view of a panel 322 which may be used with formworks 100, 200 of FIGS. 3A and 4A. In many respects, panel 322 is similar to panels 102 and 302 described above and similar features are referred to using similar reference numbers. Panel 322 differs from panel 302 in that panel 322 does not include brace elements 310, 312. In other respects, panel 322 may be similar to panel 302 described above.

Figure 5C:
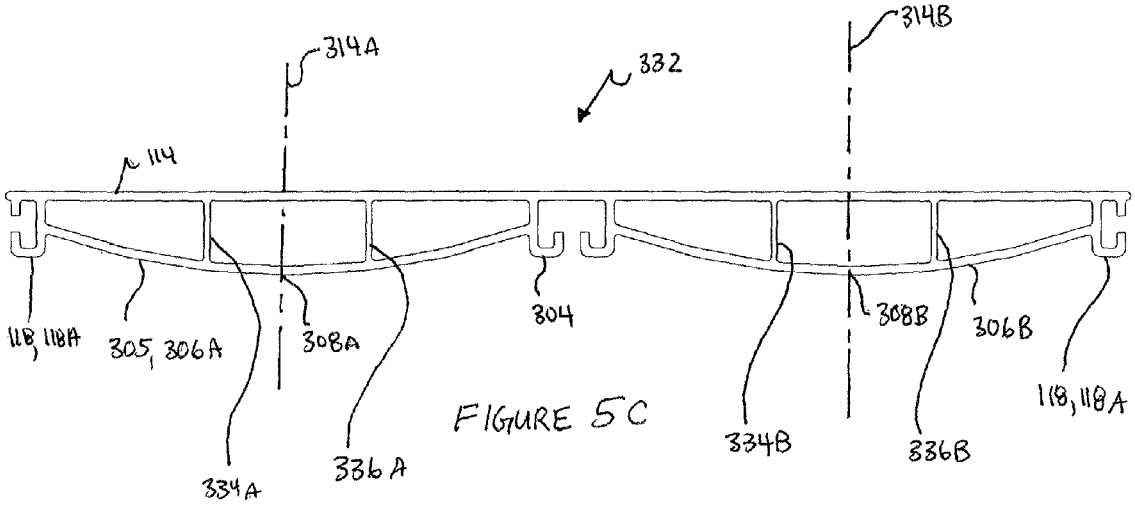

FIG. 5C is a transverse cross-sectional view of a panel 332 which may be used with formworks 100, 200 of FIGS. 3A and 4A. In many respects, panel 332 is similar to panels 102 and 302 described above and similar features are referred to using similar reference numbers. Panel 332 differs from panel 302 in that panel 332 comprises brace elements 334A, 334B, 336A, 336B (collectively, brace elements 334, 336) which extend between outer surface 114 and each of inner-surface convexities 306 at angles that are orthogonal to outer surface 114 and parallel with one another. Like brace elements 310, 312 of panel 302, brace elements 334, 336 of panel 332 differ from the brace elements of panel 102 in that each set of brace elements 334, 336 is symmetric about a notional plane 314A, 314B that corresponds to (and extends through) the apex 308 of its corresponding inner surface convexity 306. In the illustrated embodiment, panel 332 comprises a symmetric pair of brace elements 334, 336 for each inner-surface convexity 306. In other embodiments, however, panel 302 may comprise any suitable number of symmetric pairs of brace elements for each inner-surface convexity.

In other respects, panel 332 may be similar to panel 302 described above.

Figure 5D:
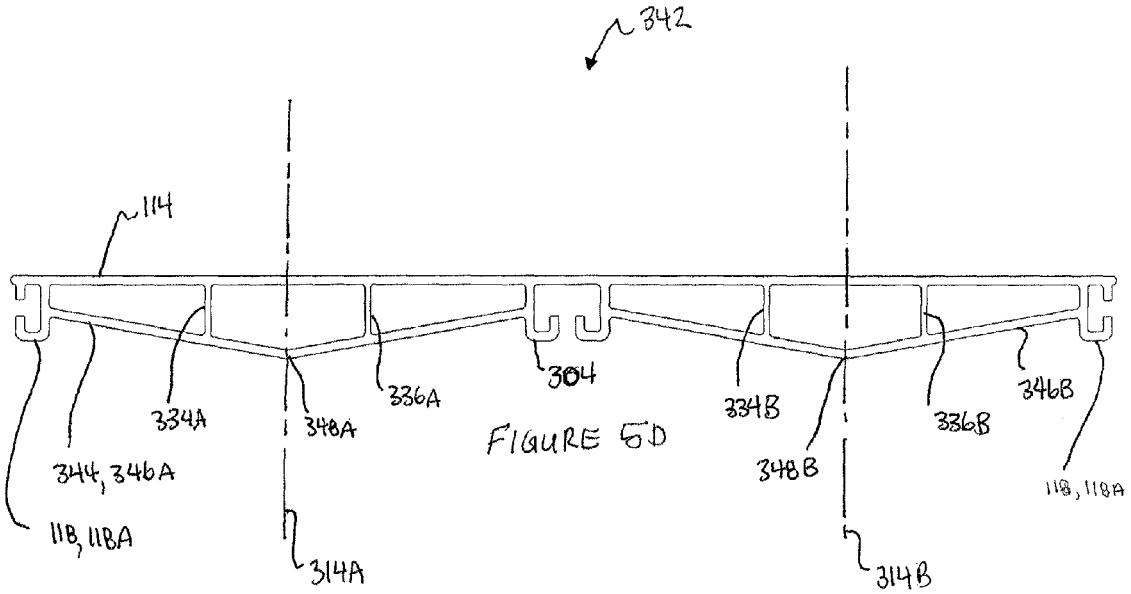

FIG. 5D is a transverse cross-sectional view of a panel 342 which may be used with formworks 100, 200 of FIGS. 3A and 4A. In many respects, panel 342 is similar to panels 102 and 332 described above and similar features are referred to using similar reference numbers. Panel 342 differs from panel 332 in that panel 342 comprises an interior surface 344 which comprises a plurality of inner-surface convexities 346A, 346B (collectively, inner-surface convexities 346) that are linearly convex (as opposed to arcuately convex). Each of inner-surface convexities 346 comprises an apex 348A, 348B (collectively, apexes 348). Like panel 332 described above, panel 342 is shown in the illustrated embodiment as comprising a pair of inner-surface convexities 346, but may be provided with any suitable number of inner-surface convexities. Brace elements 334, 336 of panel 342 are similar to brace elements 334, 336 of panel 332 in that brace elements 334, 336 of panel 342 are orthogonal to outer surface 114 and parallel with one another. In other embodiments, panel 342 may be designed with brace elements similar to brace elements 310, 312 of panel 302 (FIG. 5A)—i.e. brace elements which extend between outer surface 114 and each of inner-surface convexities 346 at angles that are non-orthogonal to outer surface 114 and non-parallel with one another.

In other respects, panel 342 may be similar to panel 332 described above.

Figure 5E:
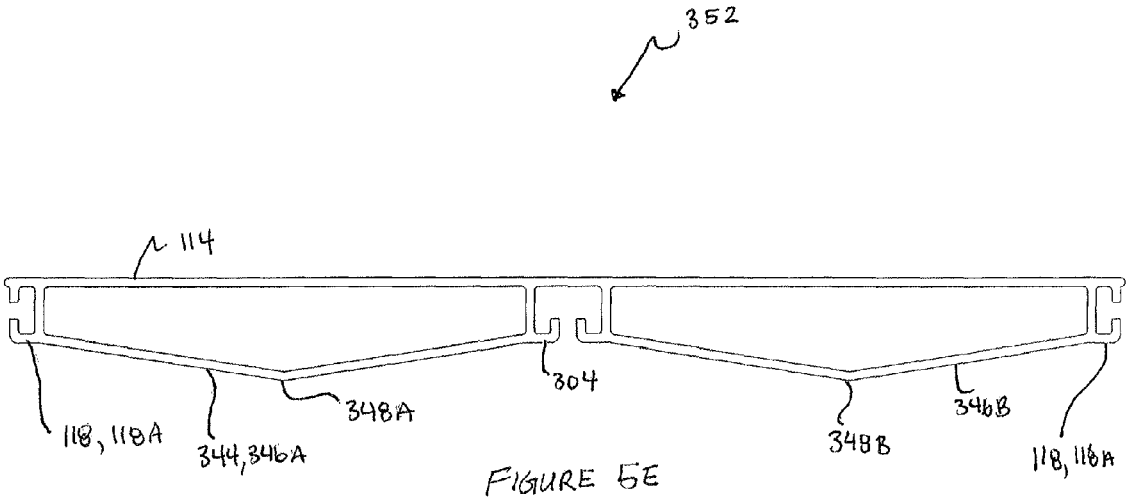

FIG. 5E is a transverse cross-sectional view of a panel 352 which may be used with formworks 100, 200 of FIGS. 3A and 4A. In many respects, panel 352 is similar to panels 102 and 342 described above and similar features are referred to using similar reference numbers. Panel 352 differs from panel 342 in that panel 352 does not include brace elements 334, 336. In other respects, panel 352 may be similar to panel 342 described above.

Figure 5F:
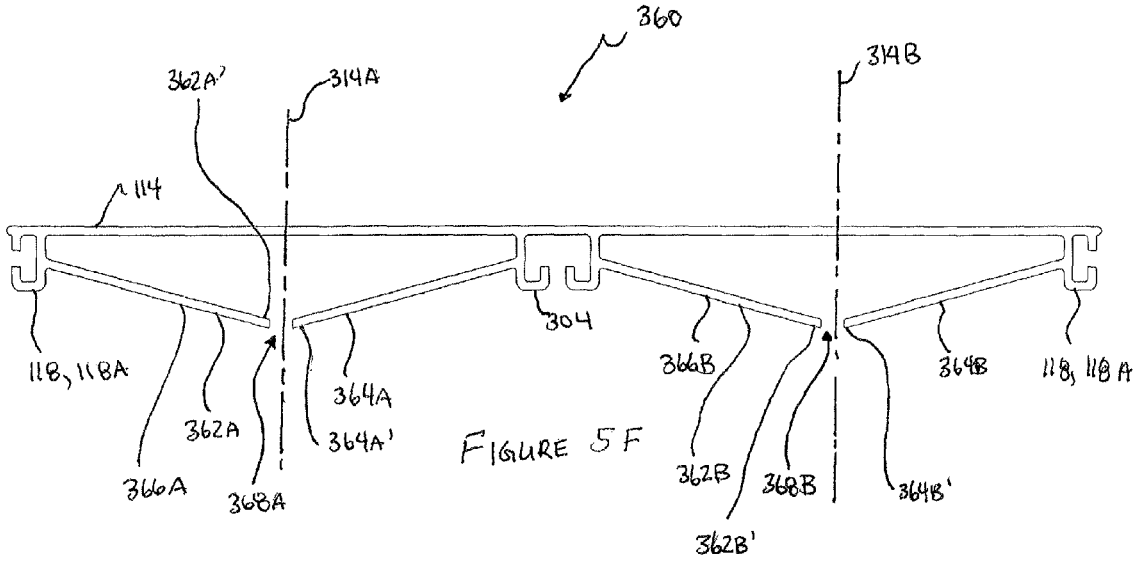

FIG. 5F is a transverse cross-sectional view of a panel 360 which may be used with formworks 100, 200 of FIGS. 3A and 4A. In many respects, panel 360 is similar to panels 102 and 352 described above and similar features are referred to using similar reference numbers. Panel 360 differs from panel 352 in that panel 360 comprises a plurality of inner-surface convexities 366A, 366B (collectively, inner-surface convexities 366), each of which are provided by a corresponding pair of cantilevered inner surface components 362A, 362B, 364A, 364B (collectively, cantilevered inner-surface components 362, 364) which are spaced apart from one another near their distal ends 362A', 362B', 364A', 364B' (collectively, distal ends 362', 364') to provide openings 368A, 368B (collectively, openings 368). Cantilevered inner-surface components 362, 364 and openings 368 may extend in the longitudinal direction (into and out of the page in the illustrated view of FIG. 5F).

When a formwork comprising panels 362 is filled with concrete, cantilevered inner-surface components 362, 364 may deform outwardly under the outward pressure caused by the weight of liquid concrete—see the outward directions of arrows 162 in FIG. 3A. As they deform, cantilevered inner-surface components 362, 364 may move toward outer surface 114 causing a corresponding growth in openings 368 and allowing concrete flow into the region between cantilevered inner-surface components 362, 364 and outer surface 114, but in doing so, may absorb some of the force which would otherwise be directed against outer surface 114. In this manner, cantilevered inner-surface components 362, 364 may reduce deformation due to the weight of concrete (e.g. pillowing and/or bellying) in a manner similar to that of the truss-shapes described in other embodiments. Further, since the profile of panels 360 is not hollow, it may be fabricated more quickly and/or less expensively. Also, openings 368 may be used to introduce insulation (e.g. foam insulation) into the regions between cantilevered arms 362, 364 and outer surface 114.

In other respects, panel 360 may be similar to panel 352 described above.

Figure 5G:
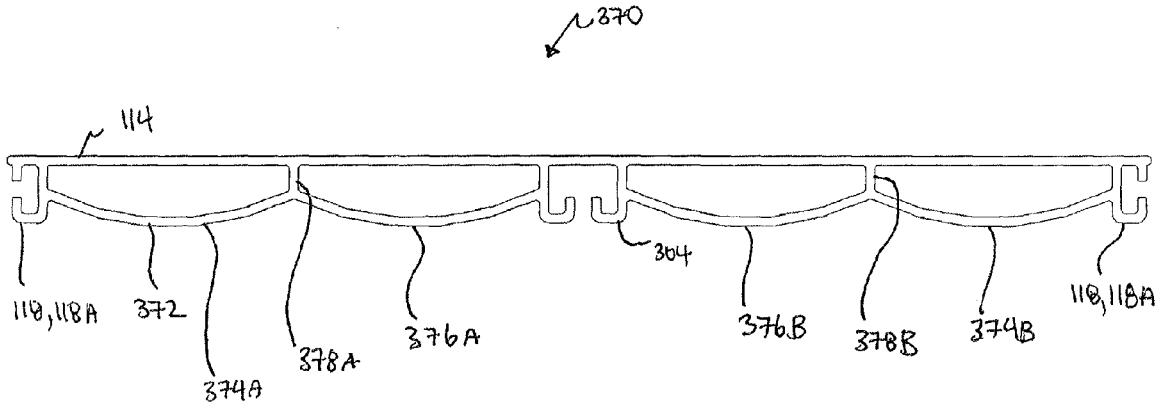

FIG. 5G is a transverse cross-sectional view of a panel 370 which may be used with formworks 100, 200 of FIGS. 3A and 4A. In many respects, panel 370 is similar to panels 102 and 322 described above and similar features are referred to using similar reference numbers. Panel 370 differs from panel 322 in that panel 370 comprises an interior surface 372 which comprises a plurality (e.g. 2 in the illustrated embodiment) of transversely adjacent inner-surface convexities 374A, 376A, 374B, 376B (collectively, inner-surface convexities 374, 376) between each of its transverse edges 118 and its interior connector component 304. In the illustrated embodiment, inner-surface convexities 374 extend between one of edges 118 and an inter-convexity brace element 378A, 378B (collectively, inter-convexity brace elements 378) and inner-surface convexities 376 extend between inter-convexity brace elements 378 and connector component 304. In other respects, inner-surface convexities 374, 376 may be similar to inner-surface convexities 306 of panel 322.

Figure 5H:
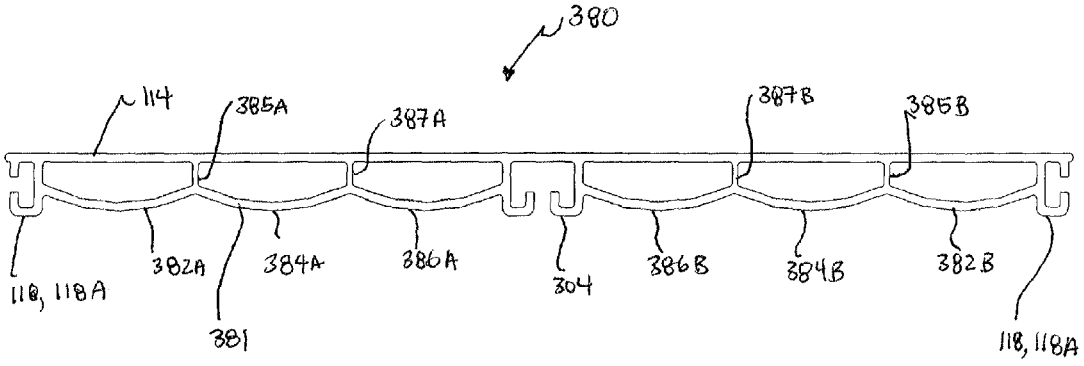

In the illustrated embodiment of FIG. 5G, panel 370 comprises a pair of transversely adjacent inner-surface convexities 374, 376 between each of its transverse edges 118 and its interior connector component 304. In other embodiments, the number of transversely adjacent inner-surface convexities between transverse edges 118 and connector component 304 may differ. For example, FIG. 5H is a transverse cross-sectional view of a panel 380 which may be used with formworks 100, 200 of FIGS. 3A and 4A. Panel 380 is similar to panels 102 and 370 described above and similar features are referred to using similar reference numbers. Panel 380 differs from panel 370 in that panel 380 comprises an interior surface 381 which comprises three transversely adjacent inner-surface convexities 382A, 384A, 386A, 382B, 384B, 386B (collectively, inner-surface convexities 382, 384, 386) between each of its transverse edges 118 and its interior connector component 304. In the illustrated embodiment: inner-surface convexities 382 extend between one of edges 118 and an inter-convexity brace element 385A, 385B (collectively, inter-convexity brace elements 385); inner-surface convexities 384 extend between inter-convexity brace elements 385 and inter-convexity brace elements 387A, 387B (collectively, inter-convexity brace elements 387); and inner-surface convexities 386 extend between inter-convexity brace elements 387 and connector component 304. In other respects, inner-surface convexities 382, 384, 386 may be similar to inner-surface convexities 306 of panel 322.

In the illustrated embodiment, panels 370, 380 each comprise one centrally located connector component 304 and a pair of pluralities (e.g. a group of 2 in the case of panel 370 and a group of 3 in the case of panel 380) of inner-surface convexities (374, 376 in the case of panel 370 and 382, 384, 386 in the case of panel 380). In other embodiments, panels similar to panels 370, 380 may be provided with different numbers (e.g. pluralities) of connector components 304, with each connector component 304 located between a pair of pluralities of inner-surface convexities. In such embodiments, a particular plurality of inner-surface convexities may extend transversely between a pair of connector components 304 (rather than between a connector component 304 and one of edges 118).

In other respects, panels 370, 380 may be similar to panel 322 described above.

Figure 5I:
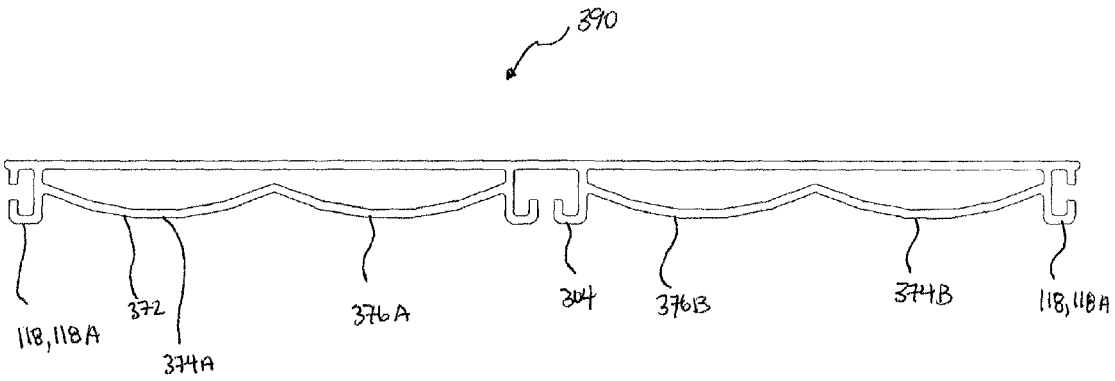

FIG. 5I is a transverse cross-sectional view of a panel 390 which may be used with formworks 100, 200 of FIGS. 3A and 4A. In many respects, panel 390 is similar to panels 102 and 370 described above and similar features are referred to using similar reference numbers. Panel 390 differs from panel 370 in that panel 390 does not include inter-convexity brace elements 378. In other respects, panel 390 may be similar to panel 370 described above.

Figure 5J:
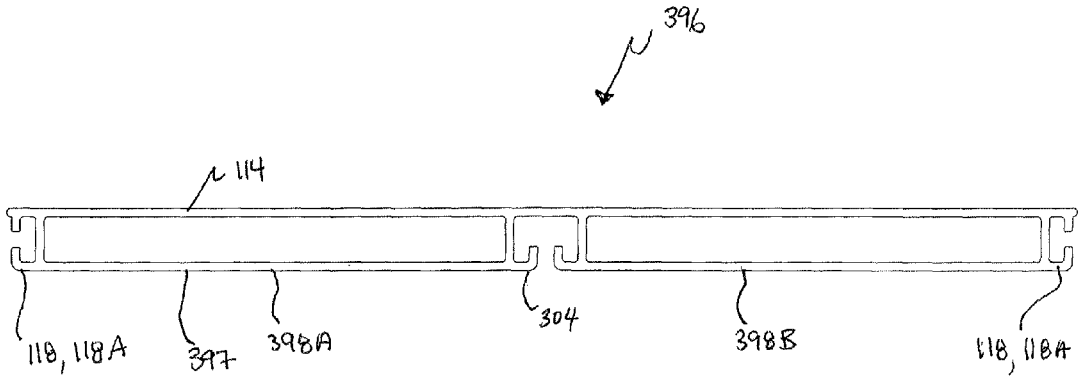

FIG. 5J is a transverse cross-sectional view of a panel 396 which may be used with formworks 100, 200 of FIGS. 3A and 4A. In many respects, panel 396 is similar to panels 102 and 322 described above and similar features are referred to using similar reference numbers. Panel 396 differs from panel 322 in that panel 390 comprises an inner surface 397 with a plurality (e.g. 2 in the illustrated embodiment) of inner-surface portions 398A, 398B (collectively, inner-surface portions 398) that are substantially parallel to outer surface portion 114, wherein each transversely adjacent pair of inner-surface portions 398 is separated by connector components 304. In the illustrated embodiment, panel 396 comprises one set of interior connector components 304 between a corresponding pair of inner-surface portions 398. It will be appreciated, however, that panels may be provided with corresponding pluralities of sets of connector components 304 between corresponding pairs of adjacent inner-surface portions 398.

In other respects, panel 396 may be similar to panel 102 described above.

Figure 6A:
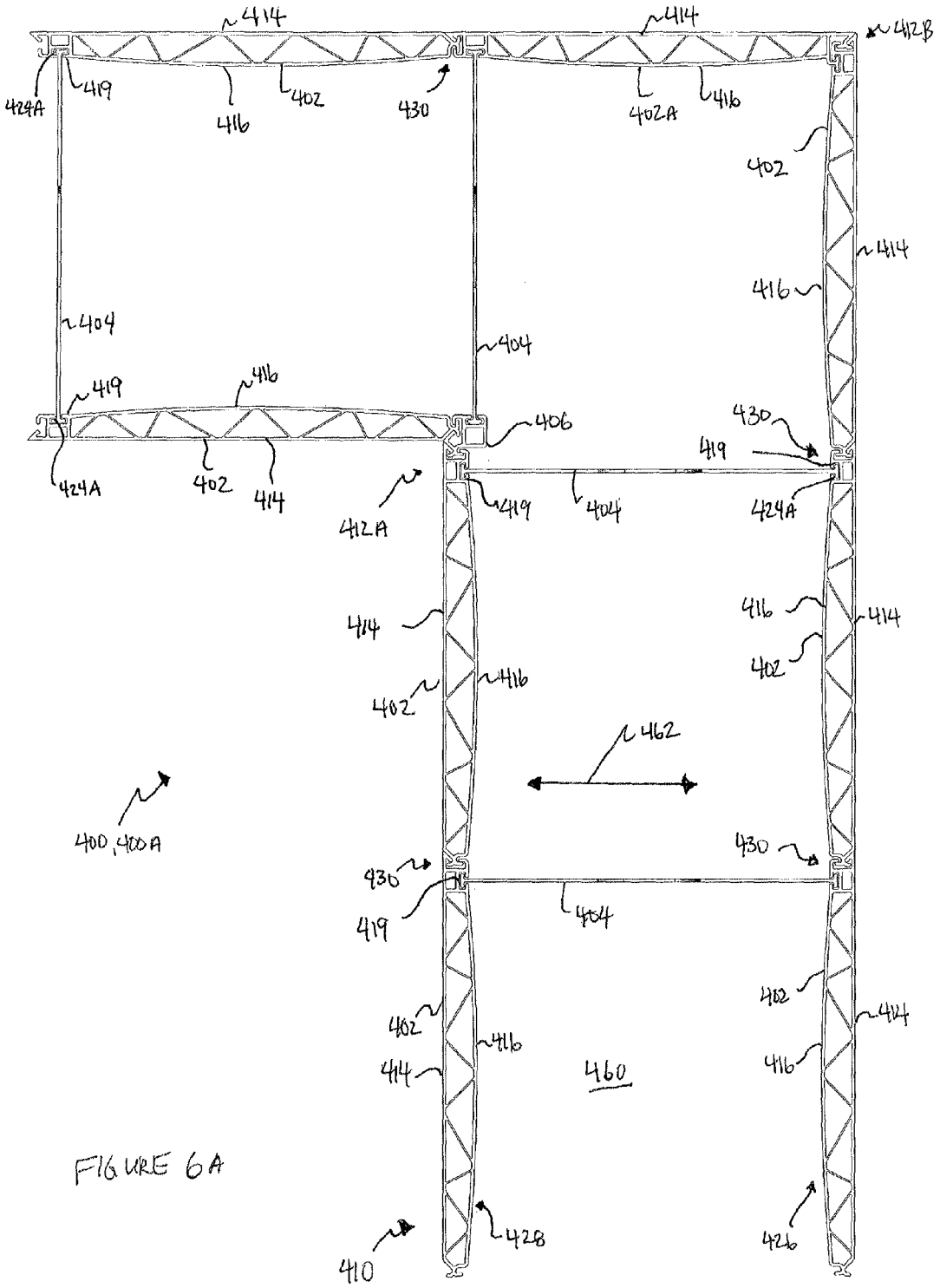
FIG. 6A is a top plan view of a portion of a modular stay-in-place formwork according to a particular embodiment.

FIG. 6A is a top plan view of a portion 400A of a formwork 400 according to a particular embodiment of the invention. Formwork portion 400A may be incorporated into a formwork 400 which may be used to fabricate a structure. Examples of formworks 400 into which formwork portion 400A may be incorporated are described, for example, in PCT patent application No. PCT/CA2008/001951 filed on 7 Nov. 2008 and entitled PIVOTALLY ACTIVATED CONNECTOR COMPONENTS FOR FORM-WORK SYSTEMS AND METHODS FOR USE OF SAME, which is hereby incorporated herein by reference.

Figure 6B:
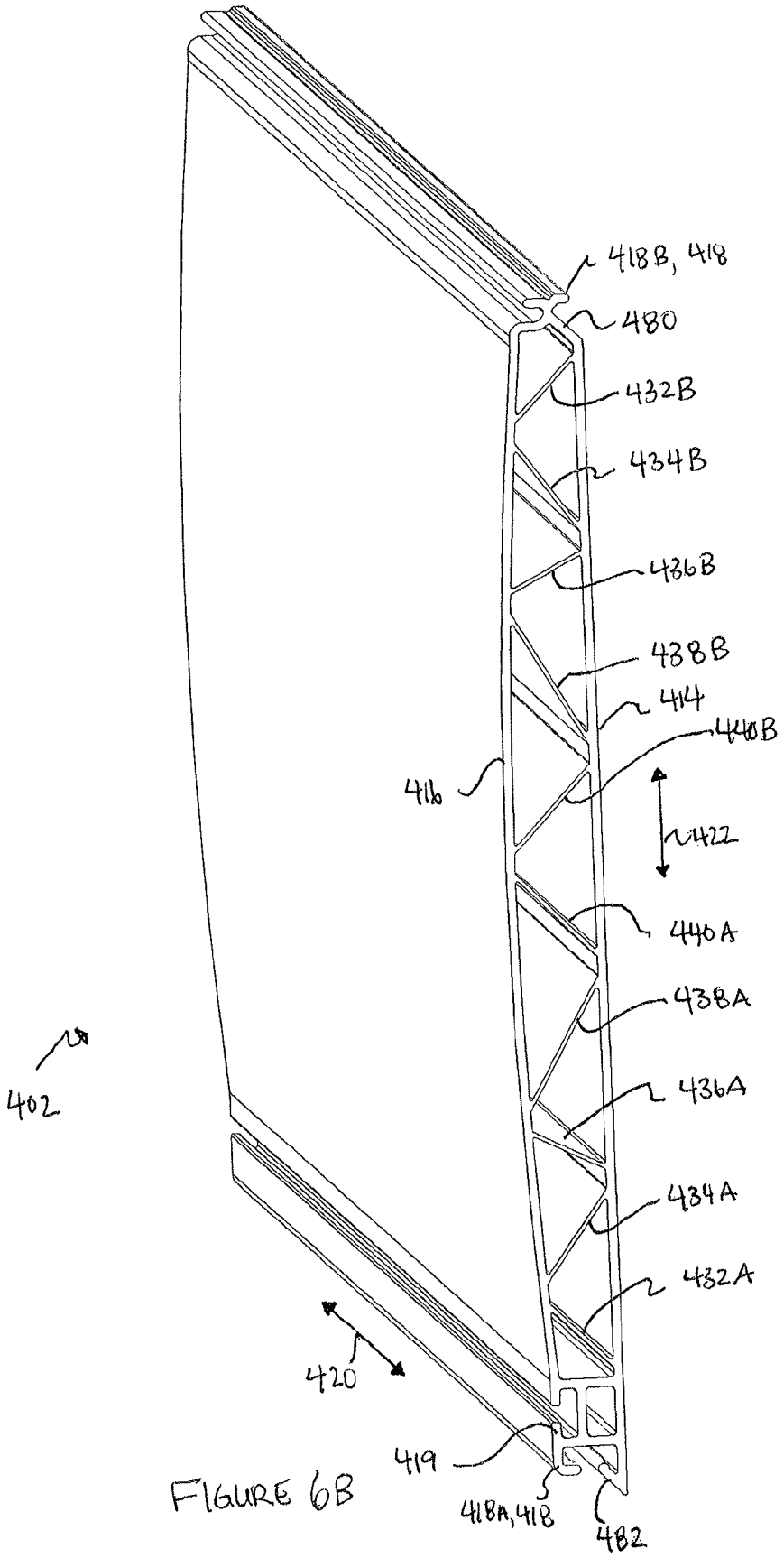
FIGS. 6B and 6C are respectively isometric views of a panel and a support member of the FIG. 6A formwork.
Figure 6C:
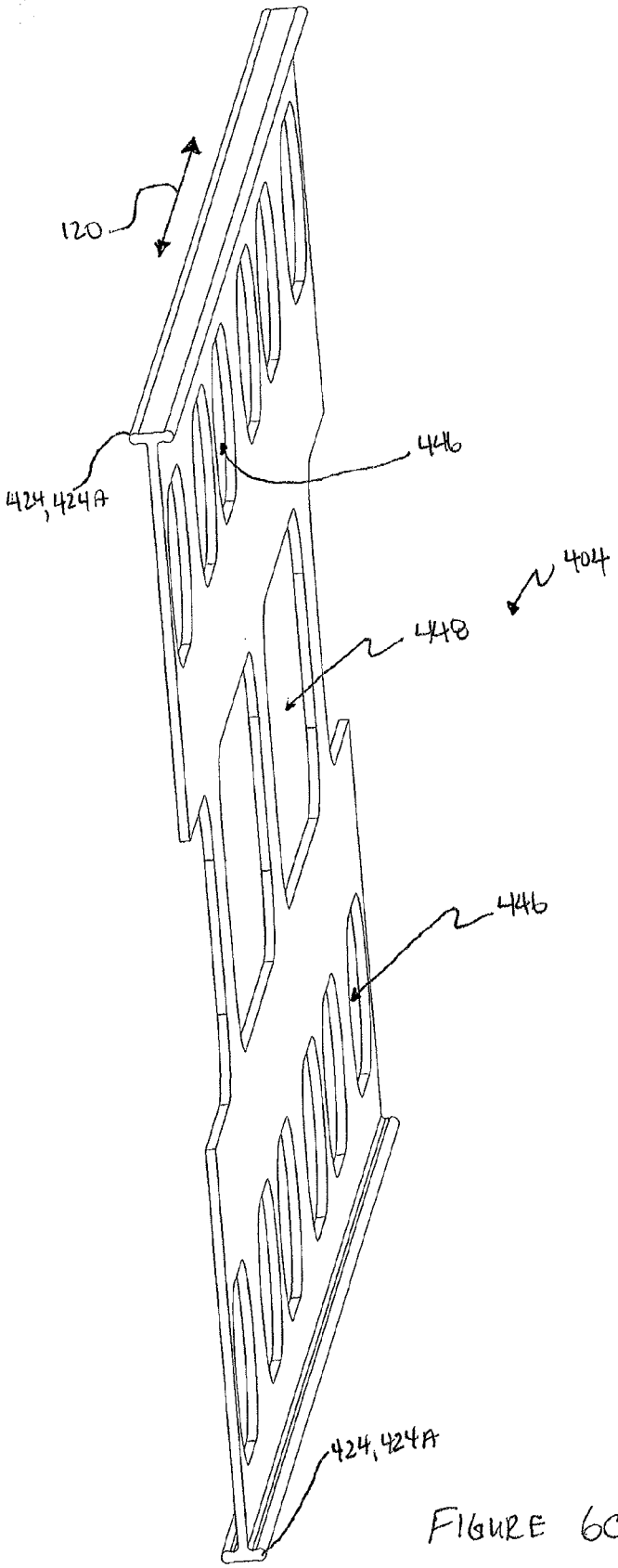
Figure 6D:
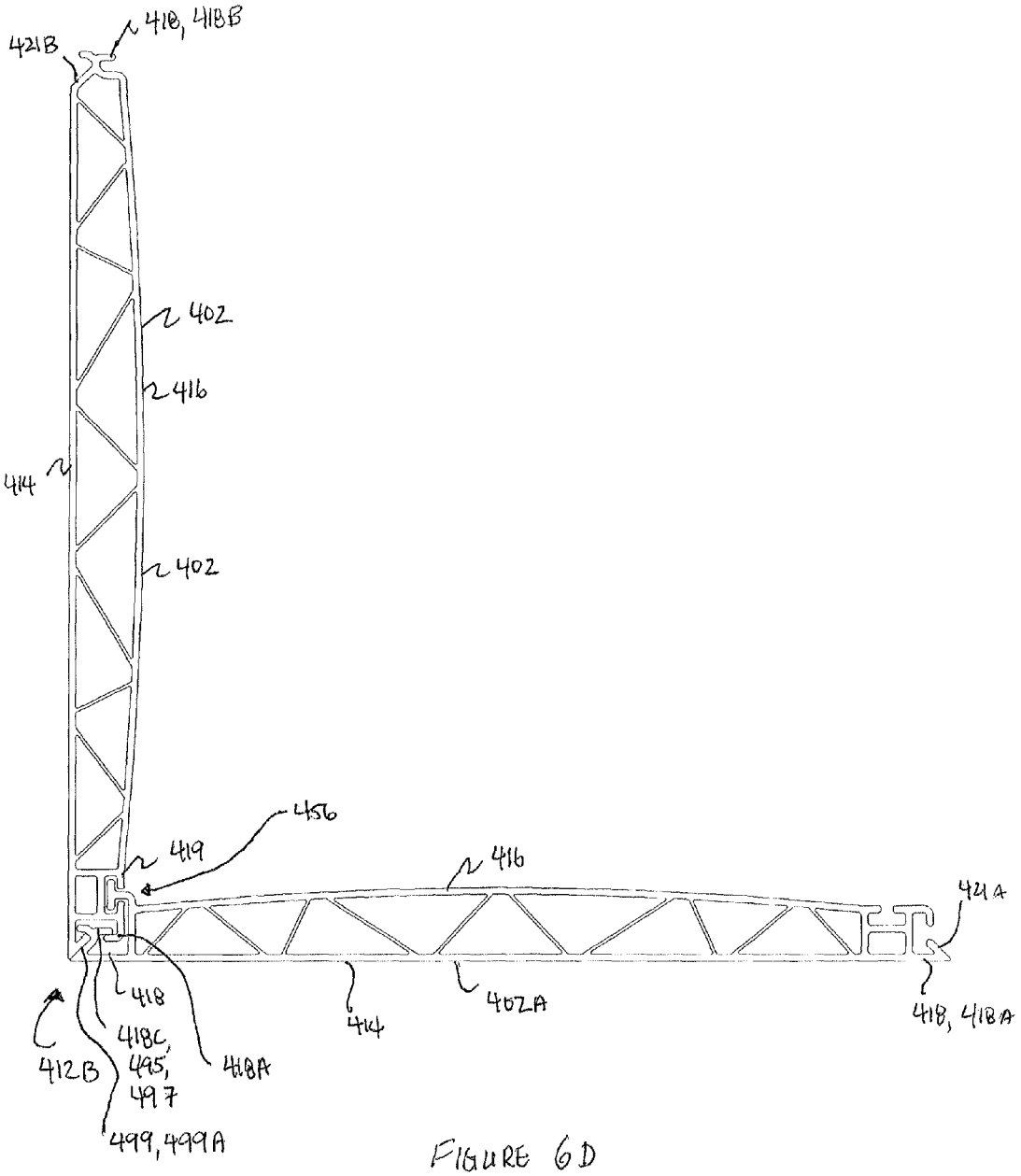
FIGS. 6D and 6E are respectively top plan views of an outside and inside corner of the FIG. 6A formwork.

In the illustrated embodiment of FIG. 6A, formwork portion 400A defines a portion of a wall 410 comprising an inside corner 412A and an outside corner 412B. Formwork portion 400A includes panels 402, 402A, 402B (generally, panels 402), which are elongated in the longitudinal direction (i.e. the direction into and out of the page in FIG. 6A). FIG. 6B is an isometric view of a panel 402 in isolation. Formwork portion 400A also includes support members 404 and a corner connector member 406, which are also elongated in the longitudinal direction. FIGS. 6C and 6D respectively depict isometric views of support member 404 and corner connector member 406 in isolation.

Panels 402, support members 404 and corner connector members 406 may be fabricated from materials and using processes similar to those described above for panels 102, support members 104 and tensioning members 106.

Panels 402 are elongated in longitudinal directions 420 and extend in transverse directions 422. In the illustrated embodiment, panels 402 have a substantially similar transverse cross-section along their entire longitudinal dimension, although this is not necessary. In general, panels 402 may have a number of features which differ from one another as explained in more particular detail below. The opposing transverse edges 418 of panels 402 comprise complementary connector components 418A, 418B, which connect directly to one another (as opposed to through a support member 404) to provide connections 430 which connect panels 402 in edge-adjacent relationship and to thereby provide wall segments 426, 428 of formwork 400.

Figure 6E:
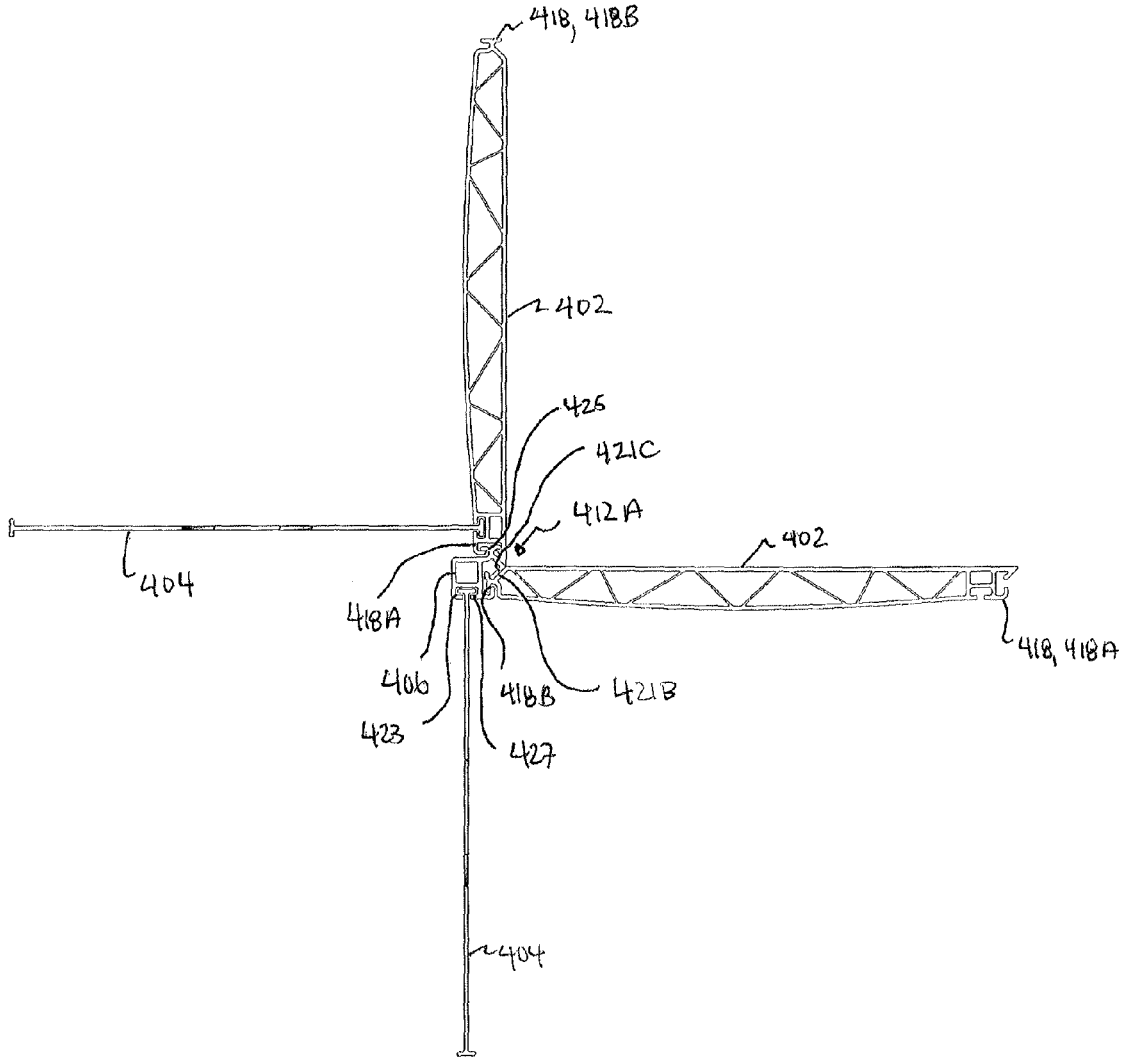
Figure 6F:
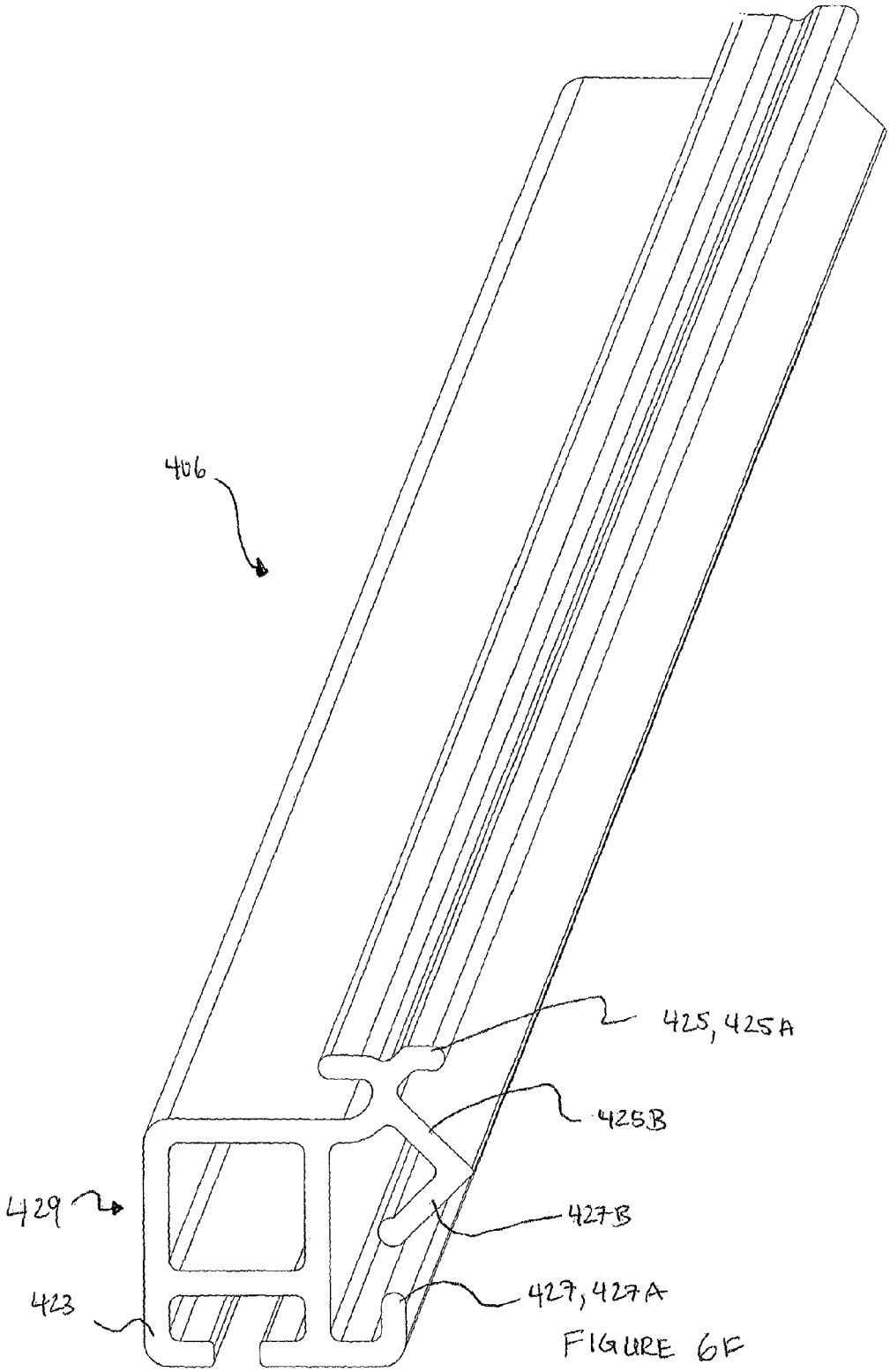
FIG. 6F is an isometric view of a corner connector member of the FIG. 6A formwork.
Figure 6G:
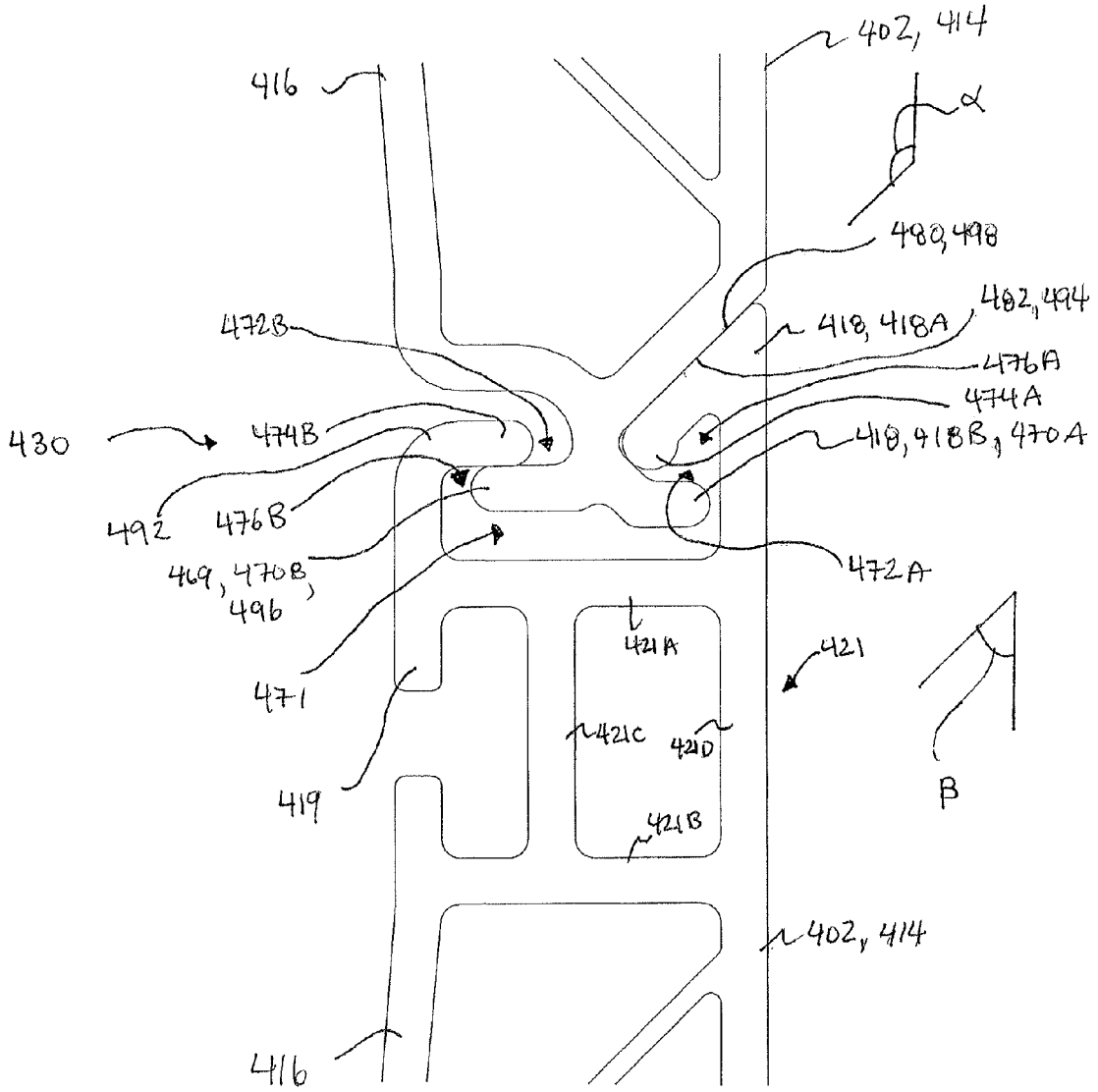
FIG. 6G is a magnified view of a connection between edge-adjacent panels of the FIG. 6A formwork.

FIG. 6G is a magnified partial top plan view of a connection 430 between complementary connector components 418A, 418B a pair of edge-adjacent panels 402. Connector component 418A may be referred to as a female connector component 418A and comprises a female engagement portion 492 and an abutment portion 494. Connector component 418B may be referred to as a male connector component 418B and comprises a male engagement portion 496 and an abutment portion 498. Forming connection 430 involves engaging engagement portions 492, 496 and abutting abutment portions 494, 498.

In the illustrated embodiment, female engagement portion 492 of connector component 418A comprises a pair of projecting arms 474A, 474B (collectively, arms 474) which are shaped to provide a principal receptacle 471 and hooks 476A, 476B (collectively, hooks 476). In the illustrated embodiment, male engagement portion 496 of connector component 418B comprises a splayed protrusion 469 comprising a pair of projecting fingers 470A, 470B (collectively, fingers 470) which are shaped to provide hooks 472A, 472B (collectively, hooks 472). When connection 430 is made, fingers 470 are inserted into principal receptacle 471 and may project into the concavities of hooks 476. Similarly, arms 474 may project into the concavities of hooks 472. With this configuration, hooks 472, 476 of engagement portions 492, 496 engage one another to form connection 430.

Abutment portion 494 of connector component 418A comprises an abutment surface 482 which is complementary to, and abuts against, abutment surface 480 of abutment portion 498 of connector component 418B when connection 430 is made. In the illustrated embodiment, abutment surface 480 is bevelled at an angle $\alpha$ with respect to exterior surface 414 of its corresponding panel 402 and abutment surface 482 is bevelled at an angle $\beta$ with respect to exterior surface 414 of its corresponding panel 402. We may define an angle $\theta_{max}$ to be the sum of the bevel angles $\alpha$, $\beta$. When connection 430 is made, $\theta_{max}$ also represents the interior angle between the exterior surfaces 414 of panels 402, provided that there is no deformation of panels 402 or connector components 418A, 418B. In the illustrated embodiment, $\alpha \approx 135°$ and $\beta \approx 45°$ so that $\theta_{max} \approx 180°$.

In other embodiments, it may be desirable that the value of $\theta_{max}$ be something other than 180°. For example, in some cases where it is desired that panels 402 join together to provide a convex surface (e.g. a curved wall where outer surfaces 414 of panels 402 form a convex surface across connection 430), the value of be less than 180° (e.g. in a range between 160° and 179°). Conversely, in some cases where it is desired that panels 402 join together to provide a concave surface (e.g. a curved wall where outer surfaces 414 of panels 402 form a concave surface across connection 430), the value of $\theta_{max}$ be greater than 180° (e.g. in a range between 181° and 200°).

In some embodiments, it may be desirable to provide $\theta_{max}$ with a value that is less than the desired ultimate angle $\theta_{desired}$ between outer surfaces 414 of panels 402. This may be accomplished, for example, by providing interior bevel angle $\beta$ and/or interior bevel angle $\alpha$ of the abutment surfaces at other angles such that the sum of interior bevel angle $\beta$ and interior bevel angle $\alpha$ (i.e. $\theta_{max}$) is less than the desired ultimate angle $\theta_{desired}$. In some embodiments, $\theta_{max}$ (the sum of bevel angles $\alpha$, $\beta$) may be designed to be in a range of 95-99.5% of the value of the desired ultimate angle $\theta_{desired}$. In still other embodiments, $\theta_{max}$ may be in a range of 97-99.5% of the value of the desired ultimate angle $\theta_{desired}$. Since $\theta_{max}$ represents the sum of the bevel angles $\alpha$ and $\beta$, it will be appreciated that selection of a value for $\theta_{max}$ may be accomplished by varying either or both of bevel angles $\alpha$ and $\beta$.

Obtaining the desired ultimate angle $\theta_{desired}$ may involve forcing abutment surfaces 480, 482 into one another or otherwise applying force to panels 402, such that the force causes deformation of panels 402 (or more particularly, connector components 418A, 418B) and so that the interior angle between panels 402 across connection 430 increases from $\theta_{max}$ to $\theta_{desired}$. Such force may be applied when support members 404 are connected to panels 402 or by the weight of liquid concrete, for example. Under such forces, the angle between the exterior surfaces 414 of panels 402 changes from $\theta_{max}$ to a value closer to the desired ultimate angle $\theta_{desired}$. Accordingly, selecting a value of $\theta_{max} < \theta_{desired}$ may effectively result in an angle between the exterior surfaces 414 of panels 402 that is closer to $\theta_{desired}$ (after the application of force and the corresponding deformation of panels 402 and/or connector components 418A, 418B).

Providing a value of $\theta_{max} < \theta_{desired}$ may involve an application of force which increases the sealing force between connector components 418A, 418B of panels 402—e.g. pulling the hooks 476 of engagement portion 492 of connector component 418A toward, and into more forceful engagement with, the hooks 472 of engagement portion 496 of connector component 418B, thereby increasing the sealing force between connector components 418A, 418B of panels 492. Further the application of force to cause an increase from $\theta_{max}$ to $\theta_{desired}$ will include outward components which create torques which tend to push abutment surfaces 482, 480 toward, and into more forceful engagement with one another.

In other embodiments, connector components 418A, 418B may be different than those shown in the illustrated embodiment and may connect to one using techniques other than relative sliding, such as, by way of non-limiting example, deformable "snap-together" connections, pivotal connections, push on connections and/or the like.

Each of the panels 402 of the illustrated embodiment, comprises an outer surface 414 which faces an exterior of its associated formwork wall segment 426, 428 and an inner surface 416 which faces an interior of its associated formwork wall segment 426, 428. In the illustrated embodiment, outer surface 414 and inner surface 416 are respectively substantially similar to outer surface 114 and inner surface 116 of panel 102 described above. Extending between outer surface 414 and inner surface 416, panel 402 comprises a plurality of brace elements 432A, 432B, 434A, 434B, 436A, 436B, 438A, 438B, 440A, 440B. Brace elements 432A, 432B, 434A, 434B, 436A, 436B, 438A, 438B, 440A, 440B of panels 402 may be substantially similar to brace elements 132A, 132B, 134A, 134B, 136A, 136B, 138A, 138B, 140A, 140B of panels 102 described above.

Panels 402 of the illustrated embodiment also comprise connector components 419 for connection to complementary connector components 424A at the inner and outer ends 424 of support members 404. In the illustrated embodiment, connector components 419 of panels 402 are located adjacent to connector components 418A and, consequently, connections between panels 402 and support members 404 are located adjacent to connector components 418A. In the illustrated embodiment, connector components 419 comprise female C-shaped connector components for slidably receiving male T-shaped connector components 424A of support members 404. This is not necessary, however, and in other embodiments, connector components 419, 424A may be different than those shown in the illustrated embodiment and may connect to one using techniques other than relative sliding, such as, by way of non-limiting example, deformable "snap-together" connections, pivotal connections, push on connections and/or the like.

Panels 402 also comprise connector component reinforcement structures 421 which reinforce connector components 419 and 418A and provide panels 402 with additional stiffness and resistance to deformation in the region of connector components 419 and 418A. In the illustrated embodiment, connector component reinforcement structures 421 are rectangular shaped comprising inward/outward members 421A, 421B and transverse members 421C, 421D, although this is not necessary. In other embodiments, connector component reinforcement structures 421 could be provided with other shapes, while performing the same or similar function. For example, connector component reinforcement structures 421 could be made to have one or more non-orthogonal and non-parallel brace elements (e.g. similar to brace elements 132A, 132B, 134A, 134B, 136A, 136B, 138A, 138B, 140A, 140B described above) or connector component reinforcement structures 421 could be made to have one or more orthogonal and parallel brace elements (e.g. similar to brace elements 334A, 334B, 336A, 336B described above).

Accordingly, formwork 400 differs from formwork 100 in that panels 402 comprise complementary connector components 418A, 418B so as to be able to connect directly to one another in edge-adjacent relationship (i.e. without intervening support members). Furthermore, panels 402 of formwork 400 comprise connector components 419 which connect to complementary connector components 424A of support members 404, so that panels 402 connect to support members 404 at locations away from the transverse edges 418 of panels 404. Still further, panels 402 of formwork 400 comprise connector component reinforcement structures 421 which reinforce connector components 419 and 418A and provide panels 402 with additional stiffness and resistance to deformation in the region of connector components 419 and 418A.

In the illustrated embodiment, a slightly different panel 402A is used to provide outside corner 412B. FIG. 6D shows a magnified top plan view of a panel 402A connected to a normal orthogonal panel 402 to provide outside corner 412B. Panel 402A comprises a connector component 418C at one of its edges 418 which is oriented at an orthogonal angle and which connects to a complementary connector component 418A on orthogonal panel 402 to provide outside corner connection 456 wherein orthogonal panels 402, 402A connect directly to one another. In the illustrated embodiment, connector component 418C of panel 402A comprises: an engagement portion 495 which comprises T-shaped male connector component 497 that may be slidably received in the principal receptacle 471 of engagement portion 492 of female connector component 418A of orthogonal panel 402 (e.g. to engage hooks); and an abutment portion 499 which comprises an abutment surface 499A that abuts against abutment surface 482 of abutment portion 494 of female connector component 418A of orthogonal panel 402. This is not necessary. In other embodiments, connector components 418C, 418A of panels 402A, 402 may comprise any of the types of connector components described above in relation to connector components 118A, 124A. While outside corner 412B is shown as a 90° (orthogonal corner), this is not necessary. Those skilled in the art will appreciate that panels 402A, 402 could be modified to provide an outside corner having a different angle. In other respects, panel 402A is substantially similar to panel 402. Elsewhere in this description, references to panels 402 should be understood to include panels 402A where appropriate.

In the illustrated embodiment, a corner connector member 406 is used to provide inside corner 412A. FIG. 6E shows a magnified top plan view of inside corner 412A and FIG. 6F shows an isometric view of corner connector member 406. Corner connector member 406 of the illustrated embodiment comprises three connector components which include: a connector component 423 for connection to, and complementary with, connector component 424A of support member 404; a connector component 425 for connection to, and complementary with, female connector component 418A of one panel 402; and a connector component 427 for connection to, and complementary with, male connector component 418B of a second panel 402. In the illustrated embodiment: connector component 423 comprises a C-shaped female slidable connector component for receiving a complementary T-shaped connector component 424A of support member 404; connector component 425 comprises a male engagement portion 425A and an abutment portion 425B for engaging the corresponding female engagement portion 492 and abutment portion 494 of female connector components 418A of one panel 402; and connector component 427 comprises an engagement portion 427A and an abutment portion 427B for engaging the corresponding male engagement portion 496 and abutment portion 498 of male connector component 418B of the second panel 402. This is not necessary. In other embodiments, connector components 423, 425, 427 of corner connector member 406 and complementary connector components 424A of support members 404 and 418A, 418B of panels 402 may comprise any of the types of connector components described above in relation to connector components 118A, 124A. Connector components 423, 425, 427 of corner connector component 406 permit the connection of a support member 404 and a pair of orthogonally oriented panels 402 which provide interior corner 412A.

Corner connector member 406 also comprises a connector component reinforcement structure 429 which, in the illustrated embodiment, is similar to connector component reinforcement structure 421 described herein, except that connector component reinforcement structure 429 reinforces connector components 423, 425 and 427 of corner connector member 406. Connector component reinforcement structure 429 may have features similar to connector component reinforcement structure 421 described herein. While inside corner 412A is shown as a 90° (orthogonal corner), this is not necessary. Those skilled in the art will appreciate that corner connector member 406 could be modified to provide an inside corner having a different angle.

In operation, formwork 400 is assembled as describe above by connecting panels 402 to one another in edge-adjacent relationships using connector components 418A, 418B; connecting support members 404 to panels 402 using connector components 419, 424A; connecting panels 402, 402A to provide any outside corners 112B; and connecting corner connector members 406, panels 402 and support members 404 to one another to provide any inside corners 112A. Ends of wall segments (e.g. wall segments 426, 428) may be finished with end panels (not shown) which may be similar to support members 404, except without apertures 446, 448 and with connector components 424A on one side only. In other embodiments, such end panels are not required and ends of wall segments may be finished with conventional removable formwork components (e.g. reinforced plywood). Once formwork 400 is assembled, concrete (or some other suitable curable construction material) is introduced into an interior 460 of formwork 400—e.g. between inner surfaces 416 of opposing panels 402 of opposing formwork wall segments 126, 128. Pressure caused by the weight of the liquid concrete in interior region 460 will exert outward force on inner surfaces 416 of panels 402—for example in the directions indicated by arrows 462.

However, the configuration of panels 402 (including the shape of inner surface 416 and the orientations of brace elements 432A, 432B, 434A, 434B, 436A, 436B, 438A, 438B, 440A, 440B) may tend to reduce the deformation of panels 402 (or at least the deformation of outer surfaces 414 of panels 402) relative to that of prior art panels in a manner similar to the shape of inner surface 116 and the orientations of brace elements 132A, 132B, 134A, 134B, 136A, 136B, 138A, 138B, 140A, 140B described above.

Once introduced into interior 460 of formwork 400, the concrete (or other suitable curable construction material) is permitted to solidify. The result is a structure (e.g. a wall) that has its surfaces covered by stay-in-place formwork 400 (e.g. panels 402).

Figure 7A:
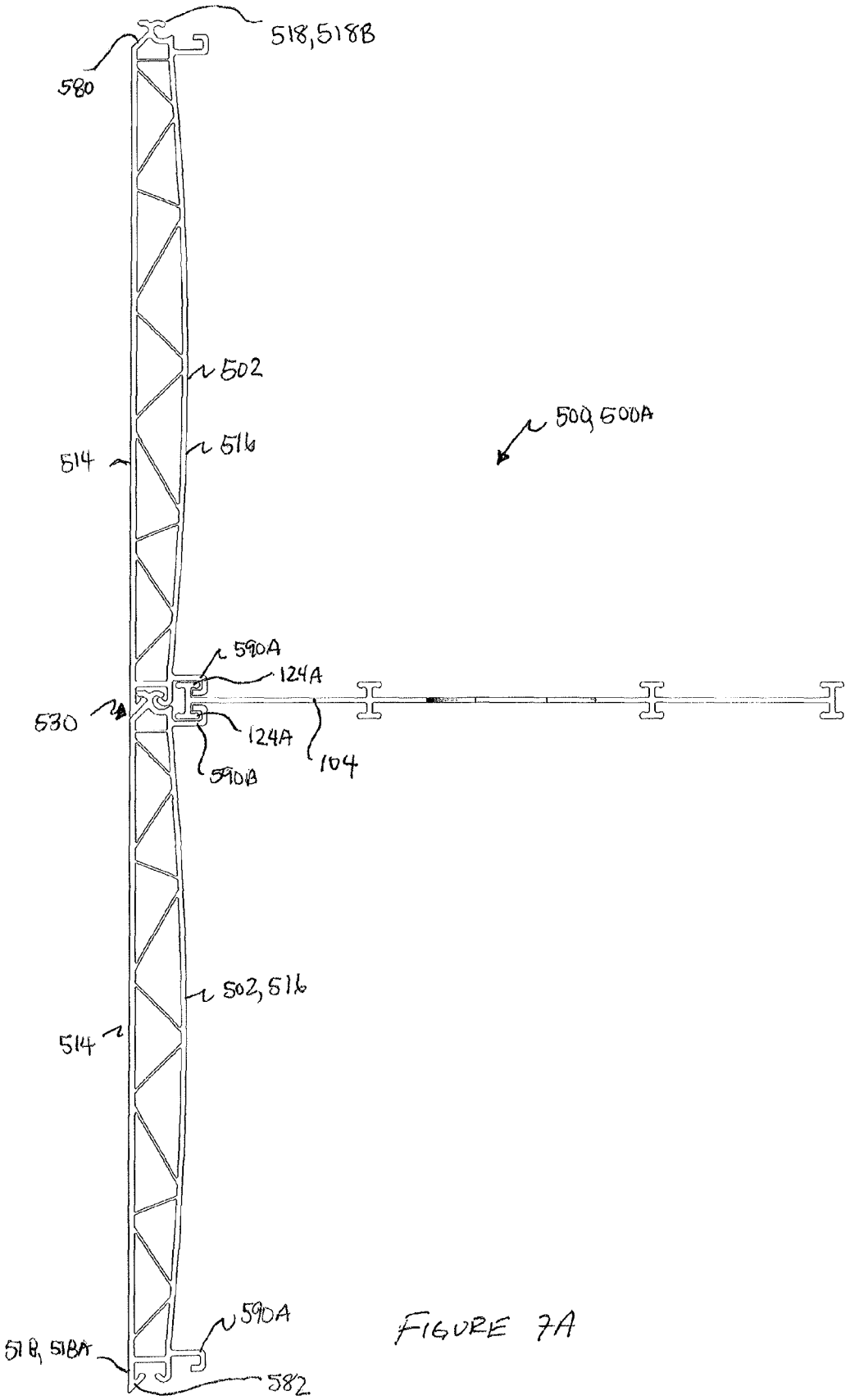
FIG. 7A is a top plan view of a portion of a modular stay-in-place formwork according to a particular embodiment.

FIG. 7A is a top plan view of a portion 500A of a formwork 500 according to a particular embodiment of the invention. Formwork portion 500A and formwork 500 are similar in many respects to formwork portions 100A, 400A and formworks 100, 400 described above and similar reference numbers are used to refer to similar features, except that features of formwork portion 500A and formwork 500 are referred to using reference numbers preceded by the numeral "5" whereas features of formwork portion 100A and formwork 100 are referred to using reference numbers preceded by the numeral "1" and features of formwork portion 400A and formwork 400 are referred to using reference numbers preceded by the numeral "4".

Formwork 500 includes support members 104 that is substantially identical to those described above for formwork 100. Formwork 500 also comprises panels 502 which are similar to panels 402 described above and comprise complementary connector components 518A, 518B at their transverse edges 518 which are similar to complementary connector components 418A, 418B described above and which provide direct connections 530 between edge-adjacent panels 502.

Figure 7B:
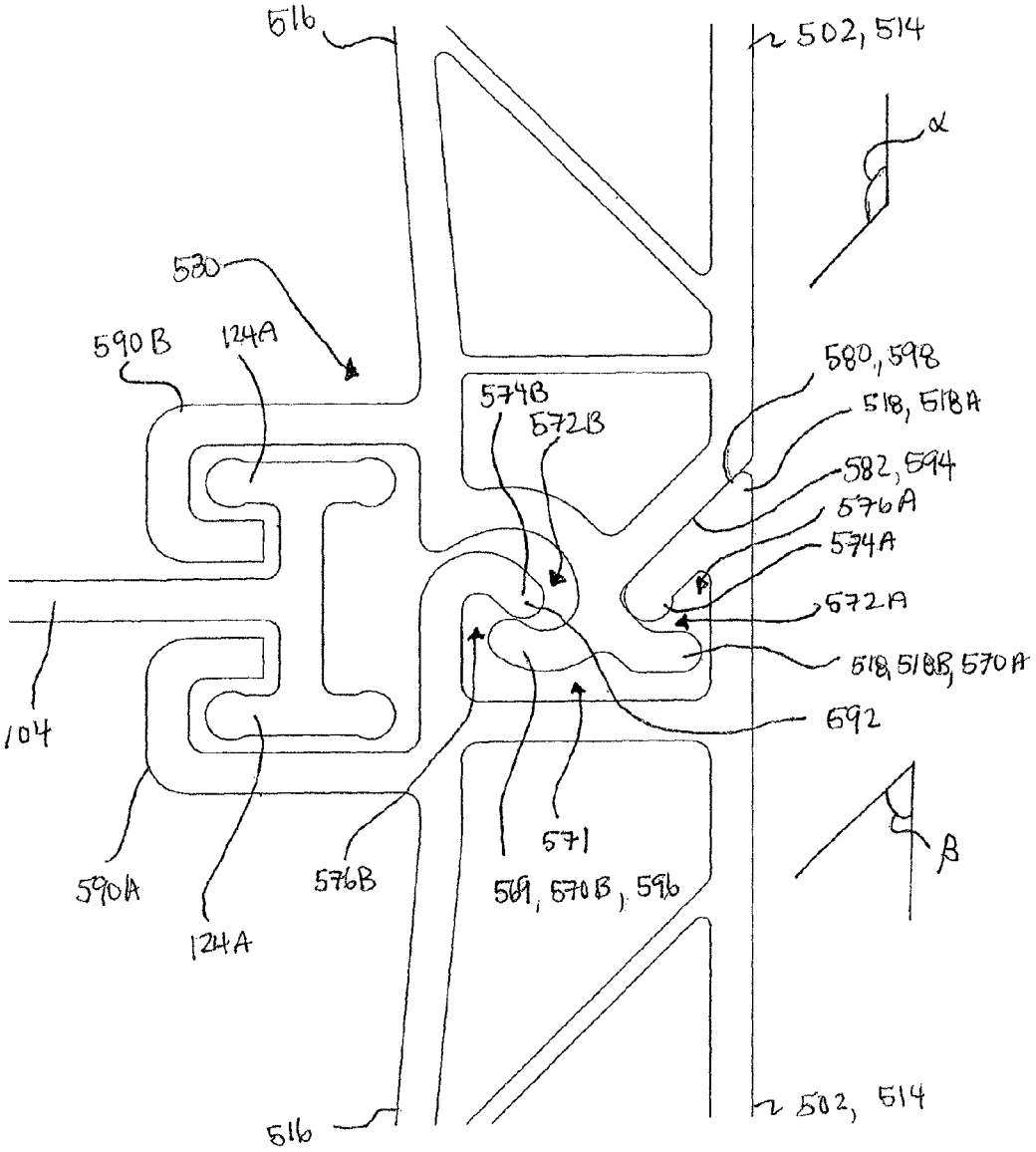
FIG. 7B is a magnified view of a connection between edge-adjacent panels of the FIG. 7A formwork.

FIG. 7B is a magnified partial top plan view of a connection 530 between complementary connector components 518A, 518B a pair of edge-adjacent panels 502. Female connector component 518A is similar in many respects to female connector component 418A described herein and comprises: an engagement portion 592 comprising a pair of projecting arms 574A, 574B (collectively, arms 574) which are shaped to provide a principal receptacle 571 and hooks 576A, 576B (collectively, hooks 576); and an abutment portion 594 which comprises an abutment surface 582. Male connector component 518B is similar in many respects to male connector component 418B described herein and comprises: an engagement portion 596 comprising a splayed protrusion 569 with a pair of projecting fingers 570A, 570B (collectively, fingers 570) which are shaped to provide hooks 572A, 572B (collectively, hooks 572); and an abutment portion 598 comprising an abutment surface 580. When connection 530 is made, engagement portions 592, 596 engage one another. More particularly, fingers 570 are inserted into principal receptacle 571 and may project into the concavities of hooks 576. Similarly, arms 574 may project into the concavities of hooks 572. With this configuration, hooks 572, 576 engage one another to form connection 530.

When connection 530 is made, abutment portion 594, 598 abut against one another. More particularly, abutment surface 582 of connector component 518A abuts against abutment surface 580 of connector component 518B when connection 530 is made. Abutment surfaces 580, 582 may comprise features (including bevel angles $\alpha$, $\beta$ and their relationship to the maximum angle $\theta_{max}$ and the desired ultimate angle $\theta_{desired}$) which are substantially similar to the features of abutment surfaces 480, 482 described herein.

FIG. 7B also shows how each of edge-adjacent panels 502 comprises a corresponding connector component 590A, 590B (collectively, connector components 590) which engages a complementary connector component 124A of support member 104 to connect support member 104 to panels 502 just interior to connection 530 between edge-adjacent panels 502. In the illustrated embodiment, each of connector components 590 comprises a J shaped female connector component which slidably receives a complementary T-shaped male connector component 124A of support member 104. This is not necessary. In other embodiments, connector components 590, 124A may comprise any of the types of connector components described above in relation to connector components 118A, 124A.

In other respects, formwork 500 may be similar to formworks 100, 400 described herein.

Figure 8:
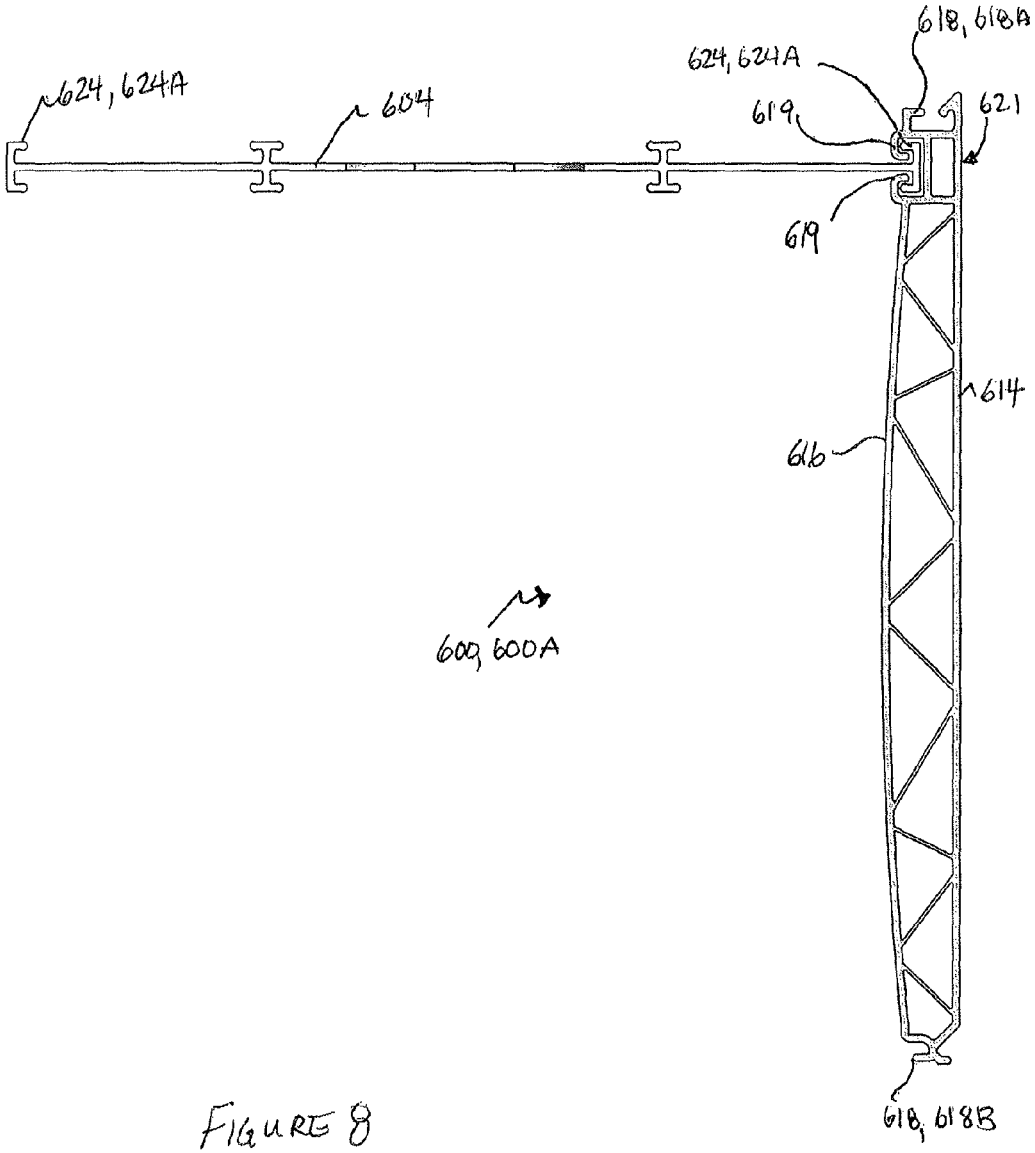
FIG. 8 is a top plan view of a portion of a modular stay-in-pace formwork according to a particular embodiment.

FIG. 8 is a top plan view of a portion 600A of a formwork 600 according to a particular embodiment of the invention. Formwork portion 600A and formwork 600 are similar in many respects to formwork portions 400A and formwork 400 described above and similar reference numbers are used to refer to similar features, except that features of formwork portion 600A and formwork 600 are referred to using reference numbers preceded by the numeral "6" whereas features of formwork portion 400A and formwork 400 are referred to using reference numbers preceded by the numeral "4".

Formwork 600 comprises panels 602 having outer surfaces 614 and inner surfaces 616 and which connect directly to one another by engagement between connector components 618A, 618B. Formwork 600 also comprises support members 604. Formwork 600 differs from formwork 400 in that support members 604 comprise connector components 624A which have hooked shapes for engaging complementary hook-shaped connector components 619 on panels 602. These hook-shaped connector components 624A, 619 may be stronger than those of formwork 400. To accommodate the extra depth of hook-shaped connector components 619, connector component reinforcement structure 621 of panel 602 may have dimensions that are smaller than those of connector component reinforcement structure 421. In other respects, formwork 600 may be similar to formwork 400 described herein.

Although the operations of the method(s) herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

Where a component (e.g. a panel, a support member, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Those skilled in the art will appreciate that directional conventions such as "vertical", "transverse", "horizontal", "upward", "downward", "forward", "backward", "inward", "outward", "vertical", "transverse" and the like, used in this description and any accompanying claims (where present) depend on the specific orientation of the apparatus described. Accordingly, these directional terms are not strictly defined and should not be interpreted narrowly.

Unless the context clearly requires otherwise, throughout the description and any accompanying claims (where present), the words "comprise," "comprising," and the like are to be construed in an inclusive sense, that is, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. Additionally, the words "herein," "above," "below," and words of similar import, shall refer to this document as a whole and not to any particular portions. Where the context permits, words using the singular or plural number may also include the plural or singular number respectively. The word "or," in reference to a list of two or more items, covers all of the following interpretations of the word: any of the items in the list, all of the items in the list, and any combination of the items in the list.

While a number of exemplary aspects and embodiments have been discussed above, those of skill in the art will recognize certain modifications, permutations, additions and sub-combinations thereof. For example:

In some embodiments, it may be desirable to provide walls which incorporate insulation. Insulation may be provided in the form of rigid foam insulation. Non-limiting examples of suitable materials for rigid foam insulation include: expanded poly-styrene, poly-urethane, poly-isocyanurate or any other suitable moisture resistant material. By way of non-limiting example, insulation layers may be provided in any of the forms described herein. Such insulation layers may extend in the longitudinal direction and in a transverse direction (i.e. between the interior and exterior surfaces of a form-work). Such insulation layers may be located centrally within the wall or at one side of the wall. Such insulation may be provided in segments whose transverse widths match those of the panels (e.g. panels 102) described herein and may fit between corresponding pairs of support members (e.g. support members 104) described herein. Such insulation segments may be shaped to include concavities complementary to the convex inner surfaces (e.g. inner surfaces 116) of the panels described herein. In some embodiments, sound-proofing materials may be layered into the forms described herein in a manner similar to that of insulation. In some embodiments, it may be desirable to include insulation anchors similar to those described in PCT/CA2008/000608 filed on 2 Apr. 2008 and entitled METHODS AND APPARATUS FOR PROVIDING LININGS ON CONCRETE STRUCTURES which is hereby incorporated herein by reference.

In some embodiments, insulation may be introduced into the concavities in panels. For example, insulation may be introduced into the concavities between outer surface 114 and inner surface 116 of panels 102 (e.g. between the brace elements). Insulation may be similarly introduced between in the inner and outer surfaces of any of the other panels described herein.

As is well known in the art, reinforcement bars (sometimes referred to as rebar) may be used to strengthen concrete structures. Rebar may be assembled into the formworks described above. By way of non-limiting example, rebar may be assembled into formwork 100 described above by extending rebar transversely (e.g. horizontally) through apertures 146, 148 in support members 104 (FIG. 3C) and vertically oriented rebar may be tied or otherwise fastened to the horizontal rebar.

Figure 9:
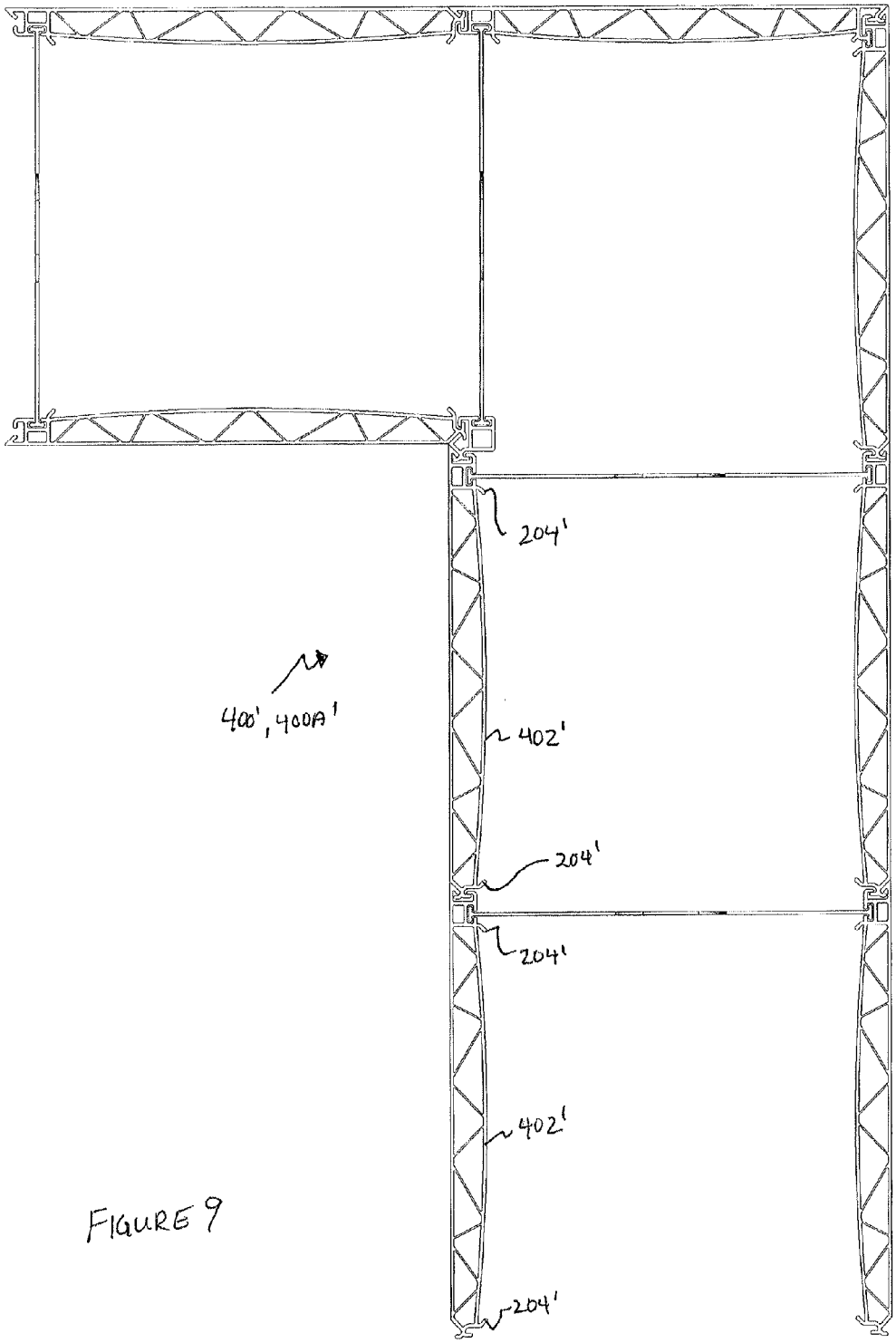
FIG. 9 is a top plan view of a portion of a modular stay-in-place formwork according to a particular embodiment.

In the embodiments of FIGS. 4A-4G panels are provided with anchoring components 204 which serve the dual purpose of providing anchoring features 206 for anchoring panels into liquid concrete and providing innermost extents 208 used to help space apart an arcuate interior surface of one panel from the flat exterior surface of another panel during storage and/or transport. Any of the other panels described herein may be provided with anchoring components having similar features. By way of non-limiting example, FIG. 9 is a top plan view of a portion 400A' of a formwork 400' according to a particular embodiment of the invention. Formwork portion 400A' is substantially similar to formwork portion 400A described herein, except that panels 402' of formwork portion 400A' comprise anchoring components 204'. Anchoring components 204' of the illustrated embodiment are substantially similar to anchoring components 204 described herein but may alternatively be varied as described herein.

Many of the embodiments described herein comprise panels which incorporate brace elements which extend between their respective interior surfaces and exterior surfaces. For example, panels 102 described herein comprise brace elements 132A, 132B, 134A, 134B, 136A, 136B, 138A, 138B, 140A, 140B which extend between outer surface 114 and inner surface 116. In some embodiments, some or all of any such brace elements may be designed to extend from the outer surface of a panel toward (but not all the way to) the inner surface of the panel. For example, some or all of brace elements 132A, 132B, 134A, 134B, 136A, 136B, 138A, 138B, 140A, 140B in panel 102 may extend from outer surface 114 toward (but not all the way to) inner surface 116. Such partially extended brace elements may provide cantilevered brace arms which can provide a multi-level resistance to deformation of the panel's outer surface due to the weight of concrete. Consider the non-limiting example where all of brace elements 132A, 132B, 134A, 134B, 136A, 136B, 138A, 138B, 140A, 140B in panel 102 are provided with this feature. When concrete is introduced into the interior 160 of formwork 100, the inner surface 116 of panels 102 can deform initially under the weight of liquid concrete. Such initial deformation of inner surface 116 may cause deformation of inner surface 116 which may cause a corresponding resistance force. Such initial deformation may no cause deformation of any of brace elements 132A, 132B, 134A, 134B, 136A, 136B, 138A, 138B, 140A, 140B, since the innermost ends of these brace elements are spaced apart from inner surface 116. Once inner surface 116 is deformed by an amount sufficient that inner surface 116 reaches the innermost ends of brace elements 132A, 132B, 134A, 134B, 136A, 136B, 138A, 138B, 140A, 140B, then further deformation of inner surface 116 under the weight of liquid concrete will be met by the resistance of deforming one or more of brace elements 132A, 132B, 134A, 134B, 136A, 136B, 138A, 138B, 140A, 140B. Such resistance may be greater than the resistance associated with deforming inner surface 116 alone. This example description provides a two level profile of resistance force to deformation due to the weight of concrete (e.g. pillowing and/or bellying). It will be appreciated that the extensions of brace elements 132A, 132B, 134A, 134B, 136A, 136B, 138A, 138B, 140A, 140B from exterior surface 114 toward inner surface 116 may be designed to provide multiple (more than two) levels of resistance profile—e.g. by providing different brace elements that extend to different degrees toward, but not into contact with inner surface 116 and so are spaced apart from inner surface 116 by different amounts, thereby creating more than two levels of resistance profile. In some embodiments, some brace elements may extend to contact inner surface 116, while other brace elements extend toward, but not into contact with inner surface 116.

In the embodiments described herein, the structural material used to fabricate the wall segments is concrete. This is not necessary. In some applications, it may be desirable to use other structural materials which may be initially be introduced placed into formworks and may subsequently solidify or cure.

In the embodiments described herein, the outward facing surfaces (e.g. surfaces 114) of some panels (e.g. panels 102) are substantially flat. In other embodiments, panels may be provided with inward/outward corrugations. Such corrugations may extend longitudinally (direction 120) and/or transversely (direction 122). Such corrugations may help to further prevent or minimize deformation of panels under the weight of liquid concrete.

In the embodiments described herein, various features of the panels described herein (e.g. connector components 118A of panels 102) are substantially co-extensive with the panels in longitudinal dimension 120. This is not necessary. In some embodiments, such features may be located at various locations on the longitudinal dimension 120 of the panels and may be absent at other locations on the longitudinal dimension 120 of the panels.

In the embodiments described herein, formworks are provided with multi-layer panels on both sides of a wall. For example, formwork portion 100 comprises panels 102 having multiple layers (inner surface 116 and outer surface 114) at both sides of wall 110—i.e. at both wall segments 126, 128. This is not necessary. In some embodiments, formworks may be provided where one side of a wall or a structure is formed with multi-layer panels and the other side of the wall or structure is formed with single surface panels. Such single surface panels may be described for example in the references incorporated herein by reference. In some embodiments, formworks may be provided (e.g. for tilt-up walls) where only one side of a wall of structure comprises a multi-layer panel and the other side of the wall is provided without panelling.

In some embodiments, the formworks described herein may be used to fabricate walls, ceilings or floors of buildings or similar structures. In general, the formworks described above are not limited to building structures and may be used to construct any suitable structures formed from concrete or similar materials. Non-limiting examples of such structures include transportation structures (e.g. bridge supports and freeway supports), beams, foundations, sidewalks, pipes, tanks, beams and the like.

Structures (e.g. walls) fabricated according to the invention may have curvature. Where it is desired to provide a structure with a certain radius of curvature, panels on the inside of the curve may be provided with a shorter length than corresponding panels on the outside of the curve. This length difference will accommodate for the differences in the radii of curvature between the inside and outside of the curve. It will be appreciated that this length difference will depend on the thickness of the structure.

Portions of connector components may be coated with or may otherwise incorporate antibacterial, antiviral, antimildew and/or antifungal agents. By way of non-limiting example, Microban™ manufactured by Microban International, Ltd. of New York, N.Y. may be coated onto and/or incorporated into connector components during manufacture thereof. Portions of connector component may additionally or alternatively be coated with elastomeric sealing materials. Such sealing materials may be co-extruded with their corresponding components.

Many embodiments and variations are described above. Those skilled in the art will appreciate that various aspects of any of the above-described embodiments may be incorporated into any of the other ones of the above-described embodiments by suitable modification.

What is claimed is:

1. A formwork for forming a concrete structure, the formwork apparatus comprising:

a plurality of elongated panels comprising connector components at their transverse edges for connecting to one another in edge-adjacent relationship;

each one of the elongated panels comprising an outer surface that extends between its transverse edges and an inner surface that extends between its transverse edges at a location inwardly spaced apart from the outer surface, the inner surface comprising one or more arcuate and inwardly projecting convexities that extend between the transverse edges and the arcuate and inwardly projecting convexities integrally coupled to the outer surface at each of the transverse edges;

each one of the elongated panels comprising one or more brace elements that extend between the inner surface and the outer surface at angles that are non-orthogonal to the outer surface; wherein:

each panel comprises a plurality of brace elements and wherein the brace elements are non-parallel with one another; and the brace elements are arranged in pairs that are symmetric about a transverse mid-plane of the panel.

2. A formwork apparatus according to claim 1 wherein a first pair of the brace elements nearest to the transverse mid-plane of each panel extends from the inner surface in directions away from the transverse mid-plane.

3. A formwork apparatus according to claim 2 wherein each of the brace elements of the first pair of the brace elements nearest to the transverse mid-plane extends from a location where the transverse mid-plane intersects the inner surface.

4. A formwork according to claim 1 wherein the formwork comprises one or more support members, each support member comprising a pair of connector components at one of its ends shaped to be complementary with, and for connecting to, the connector components at one transverse edge of each of a pair of edge-adjacent panels, such that the support member helps to provide the connection between the pair of edge-adjacent panels.

5. A formwork according to claim 1 wherein the connector components at the respective transverse edges of the panels are shaped to be complementary to one another such that pairs of edge-adjacent panels are connected directly to one another by forming a connection between their complementary connector components.

6. A formwork according to claim 5 wherein each of the transverse connector components at the respective transverse edges of the panels comprise an engagement portion shaped for engaging a complementary engagement portion of an edge-adjacent panel when a connection is made to the edge-adjacent panel and an abutment portion shaped for abutting against a complementary abutting portion of the edge-adjacent panel when the connection is made to the edge-adjacent panel.

7. A formwork according to claim 5 wherein each pair of complementary connector components which form a connection between a pair of edge-adjacent panels comprises: a female connector component comprising a female engagement portion and an abutment portion; and a male connector component comprising a male engagement portion and an abutment portion; and wherein the female connector component is shaped to receive the male engagement portion when the connection is formed and the respective abutment portions are shaped to abut against one another when the connection is formed.

8. A formwork according to claim 5 wherein each of the complementary connector components comprises a substantially planar abutment surface which is bevelled with respect to the outer surface of the panel and wherein the abutment surfaces of complementary connector components abut against one another when the connection is formed therebetween.

9. A formwork for forming a concrete structure, the formwork apparatus comprising:

a plurality of elongated panels comprising connector components at their transverse edges for connecting to one another in edge-adjacent relationship;

each one of the elongated panels comprising an outer surface that extends between its transverse edges and an inner surface that extends between its transverse edges at a location inwardly spaced apart from the outer surface, the inner surface comprising one or more arcuate and inwardly projecting convexities that extend between the transverse edges and the arcuate and inwardly projecting convexities integrally coupled to the outer surface at each of the transverse edges;

each one of the elongated panels comprising one or more brace elements that extend between the inner surface and the outer surface at angles that are non-orthogonal to the outer surface; and wherein the inner surface of each panel comprises a plurality of arcuate, transversely adjacent and inwardly projecting convexities between the transverse edges.

10. A formwork according to claim 9 comprising a support member connected to, and extending inwardly from, each panel and wherein each panel comprises a connector component located between a pair of the arcuate convexities, the connector component connected to a complementary connector component at an edge of the support member for connecting the panel to the support member.

11. A formwork according to claim 9 wherein, for each of the plurality of arcuate, transversely adjacent and inwardly projecting convexities, each panel comprises one or more brace elements that extend between the outer surface and the convexity.

12. A formwork according to claim 11 wherein, for each of the plurality of arcuate, transversely adjacent and inwardly projecting convexities, each panel comprises a plurality of brace elements and wherein the brace elements are oriented at non-orthogonal angles to the outer surface.

13. A formwork according to claim 12 wherein, for each of the plurality of arcuate, transversely adjacent and inwardly projecting convexities, the brace elements are non-parallel with one another.

14. A formwork according to claim 13 wherein, for each of the plurality of arcuate, transversely adjacent and inwardly projecting convexities, the brace elements are arranged in pairs that are symmetric about a transverse mid-plane of the convexity.

15. A formwork according to claim 14 wherein a first pair of the brace elements nearest to the transverse mid-plane of each panel extends from the inner surface in directions away from the transverse mid-plane.

16. A formwork for forming a concrete structure, the formwork apparatus comprising:

a plurality of elongated panels comprising connector components at their transverse edges for connecting to one another in edge-adjacent relationship;

each one of the elongated panels comprising an outer surface that extends between its transverse edges and an inner surface that extends between its transverse edges at a location inwardly spaced apart from the outer surface, the inner surface comprising one or more arcuate and inwardly projecting convexities that extend between the transverse edges and the arcuate and inwardly projecting convexities integrally coupled to the outer surface at each of the transverse edges;

each one of the elongated panels comprising one or more brace elements that extend between the inner surface and the outer surface at angles that are non-orthogonal to the outer surface; wherein:

each of the complementary connector components comprises a substantially planar abutment surface which is bevelled with respect to the outer surface of the panel and wherein the abutment surfaces of complementary connector components abut against one another when the connection is formed therebetween;

the connector components at the respective transverse edges of the panels are shaped to be complementary to one another such that pairs of edge-adjacent panels are connected directly to one another by forming a connection between their complementary connector components; and a first one of the abutment surfaces is bevelled at a first bevel angle with respect to the outer surface of the panel and a second one of the abutment surfaces is bevelled at a second bevel angle with respect to the outer surface of the panel and wherein a sum of the first bevel angle and the second bevel angle is about 180°prior to adding concrete to the formwork.

17. A formwork for forming a concrete structure, the formwork apparatus comprising:

a plurality of elongated panels comprising connector components at their transverse edges for connecting to one another in edge-adjacent relationship;

each one of the elongated panels comprising an outer surface that extends between its transverse edges and an inner surface that extends between its transverse edges at a location inwardly spaced apart from the outer surface, the inner surface comprising one or more arcuate and inwardly projecting convexities that extend between the transverse edges and the arcuate and inwardly projecting convexities integrally coupled to the outer surface at each of the transverse edges;

each one of the elongated panels comprising one or more brace elements that extend between the inner surface and the outer surface at angles that are non-orthogonal to the outer surface; wherein:

each of the complementary connector components comprises a substantially planar abutment surface which is bevelled with respect to the outer surface of the panel and wherein the abutment surfaces of complementary connector components abut against one another when the connection is formed therebetween;

the connector components at the respective transverse edges of the panels are shaped to be complementary to one another such that pairs of edge-adjacent panels are connected directly to one another by forming a connection between their complementary connector components; and a first one of the abutment surfaces is bevelled at a first bevel angle with respect to the outer surface of the panel and a second one of the abutment surfaces is bevelled at a second bevel angle with respect to the outer surface of the panel and wherein a sum of the first bevel angle and the second bevel angle is less than about 180° prior to adding concrete to the formwork.

18. A formwork for forming a concrete structure, the formwork apparatus comprising:

a plurality of elongated panels comprising connector components at their transverse edges for connecting to one another in edge-adjacent relationship;

each one of the elongated panels comprising an outer surface that extends between its transverse edges and an inner surface that extends between its transverse edges at a location inwardly spaced apart from the outer surface, the inner surface comprising one or more arcuate and inwardly projecting convexities that extend between the transverse edges and the arcuate and inwardly projecting convexities integrally coupled to the outer surface at each of the transverse edges;

each one of the elongated panels comprising one or more brace elements that extend between the inner surface and the outer surface at angles that are non-orthogonal to the outer surface; and wherein each panel comprises one or more brace elements that extend from the outer surface toward, but not into contact with, the inner surface.

19. A formwork according to claim 18 wherein each panel comprises one or more primary brace elements that extend from the outer surface toward, and into contact with, the inner surface.

20. A formwork according to claim 19 wherein the one or more primary brace elements of each panel comprises a plurality of primary brace elements and wherein the primary brace elements are oriented at non-orthogonal angles to the outer surface.

21. A formwork according to claim 20 wherein the primary brace elements are non-parallel with one another.

22. A formwork for forming a concrete structure, the formwork apparatus comprising:

a plurality of elongated panels comprising connector components at their transverse edges for connecting to one another in edge-adjacent relationship;

each one of the elongated panels comprising an outer surface that extends between its transverse edges and an inner surface that extends between its transverse edges at a location inwardly spaced apart from the outer surface, the inner surface comprising one or more arcuate and inwardly projecting convexities that extend between the transverse edges and the arcuate and inwardly projecting convexities integrally coupled to the outer surface at each of the transverse edges;

each one of the elongated panels comprising one or more brace elements that extend between the inner surface and the outer surface at angles that are non-orthogonal to the outer surface; and wherein each one of the panels comprises one or more anchor components that extend inwardly from the inner surface.

23. A formwork according to claim 22 wherein the one or more anchor components are positioned at one or more corresponding locations transversely spaced apart from the apexes of the one or more inwardly projecting convexities.

24. A formwork according to claim 22 wherein the one or more anchor components also extend transversely and longitudinally.

25. A formwork according to claim 22 wherein an innermost extent of each anchor component is co-planar with the apexes of the one or more inwardly projecting convexities on a notional plane that is parallel with the outer surface.

26. A formwork according to claim 22 wherein the one or more anchor components comprise a plurality of anchor components and wherein each of the plurality of anchor components extends inwardly beyond the apexes of the one or more inwardly projecting convexities.

27. A formwork apparatus for forming a concrete structure, the formwork apparatus comprising:

a plurality of elongated panels comprising connector components at their transverse edges for connecting to one another in edge-adjacent relationship;

each one of the elongated panels comprising: an outer surface that extends between its transverse edges; an inner surface that extends between its transverse edges at a location inwardly spaced apart from the outer surface, the inner surface comprising an arcuate and inwardly projecting convexity that extends between the transverse edges, the arcuate and inwardly projecting convexity integrally coupled to the outer surface at each of the transverse edges; and one or more anchor components that extend inwardly from the inner surface;

wherein an innermost extent of each anchor component is co-planar with an apex of the inwardly projecting convexity on a notional plane that is parallel with the outer surface.

28. A method of arranging panels of a stay-in place formwork for transport or storage, the method comprising:

providing a plurality of panels, each panel comprising: connector components at its transverse edges for connecting to one another in edge-adjacent relationship; an outer surface that extends between its transverse edges; and an inner surface that extends between its transverse edges at a location inwardly spaced apart from the outer surface, the inner surface comprising an arcuate and inwardly projecting convexity that extends between the transverse edges;

for each of the plurality of panels, providing the panel with one or more anchor components that extend inwardly from the inner surface wherein an innermost extent of each anchor component is co-planar with an apex of the inwardly projecting convexity on a notional plane that is parallel with the outer surface; and stacking the plurality of panels such that for each pair of adjacent panels, the apex of the inwardly projecting convexity of the inner surface and the innermost extents of the one or more anchor components of a first adjacent panel contact the outer surface of a second adjacent panel.

* * * * *